US005855106A

United States Patent [19]

Koyama et al.

[11] Patent Number: 5,855,106

[45] Date of Patent: Jan. 5, 1999

[54] FILM SUPPLYING APPARATUS AND LIFT MECHANISM FOR A PACKAGING MACHINE

[75] Inventors: Kazuo Koyama; Minoru Ooshita; Toshiyuki Sakata, all of Shiga, Japan

[73] Assignee: Ishida Co., Inc., Kyoto, Japan

[21] Appl. No.: 669,029

[22] Filed: Jun. 17, 1996

[30] Foreign Application Priority Data

Jun. 20, 1995 [JP] Japan ..... 7-178076

[51] Int. Cl.[6] ..... B65B 53/00; B65B 11/06; B65B 57/00

[52] U.S. Cl. ..... 53/556; 53/168; 53/228; 53/389.5; 53/64; 53/66

[58] Field of Search ..... 53/168, 201, 228, 53/389.5, 64, 66, 556

[56] References Cited

U.S. PATENT DOCUMENTS

| | | | |
|---|---|---|---|
| 5,014,489 | 5/1991 | Terminella et al. | 53/228 X |
| 5,144,787 | 9/1992 | Whitby et al. | 53/66 |
| 5,205,104 | 4/1993 | Nakashima et al. | 53/64 |
| 5,497,599 | 3/1996 | Hirobe | 53/168 X |

FOREIGN PATENT DOCUMENTS

| | | | |
|---|---|---|---|
| 6072406 | 3/1994 | Japan | 53/201 |
| 6183417 | 7/1994 | Japan | 53/168 |

*Primary Examiner*—Linda Johnson
*Attorney, Agent, or Firm*—Keiichi Nishimura

[57] ABSTRACT

A packaging machine has belts for clamping both side edges of a film pulled out selectably from either of two film rolls and transporting it accordingly in either direction to a packaging station. Its film supplying apparatus includes a plurality of sensors capable of detecting both presence and absence of a film. They are disposed at both ends of the belts and each sensor is adapted to output a warning signal when either the presence or absence of a film is detected thereby, depending whether it is at the downstream or upstream end of the belt with respect to the direction of film being transported thereby. A lift mechanism for such a packaging machine for lifting loaded trays of different sizes against a stretched film includes a frame, a mechanism for moving the frame selectably upward or downward, a plurality of posts standing on the frame for supporting trays thereon, some of the posts being fixed posts, which are affixed to the frame, and the others being mobile posts, which can move horizontally in a specified direction within a specified range each towards or away from an associated one of the fixed posts, a slidable member extending perpendicularly to the specified direction and capable of sliding in this direction beyond the specified range, and a controller for stopping the slidable member at a plurality of stop positions within the specified range and wait positions outside the specified range. The controller also causes the slidable member and the mobile posts to move towards or away from each other at any of the stop positions.

20 Claims, 22 Drawing Sheets

FILM SUPPLYING APPARATUS AND LIFT MECHANISM FOR A PACKAGING MACHINE

BACKGROUND OF THE INVENTION

This invention relates to a film supplying apparatus and a lift mechanism for a packaging machine of the type adapted to use a polyethylene film to wrap up not only articles like fresh foods but also the tray carrying them thereupon.

In a packaging machine of this type, the film is usually pulled out of a roll, and both side edges of a film to be cut to a specified size are clamped between upper and lower film transporting belts and transported to a packaging station where it is kept stretched. Articles carried on a tray to be packaged together therewith are pushed upwards from below by a lift against this stretched film piece. While the loaded tray is in this lifted-up position, a plurality of folding plates are activated to fold the four edge parts of the film piece downward towards the bottom surface of the tray to complete the packaging process.

With a packaging machine of this type, films with different widths are used, depending on the size of the articles to be packaged, or the size of the tray which carries them and is to be packaged together with the articles carried thereon. In such a situation, not only must the roll having a film with an incorrect width therearound be removed and another roll having a film with a correct width installed in its place, but both side edges of the front end of the newly installed film must also be set so as to be clamped by the film transporting belts. In other words, it is extremely troublesome and time-consuming to keep using films with different widths.

In view of the problem as described above, it has been known to provide two film storage spaces on both sides of the film transport belts, each film storage space storing a film roll having a film with a different width such that either of them can be selectively used for trays of a given size. Even if a packaging machine is thus provided with a film supplying apparatus having two film storage spaces, however, care must still be taken such that the end of the film not being used will not be caught by the film transporting belts. Moreover, the film from the newly installed roll must be carefully pulled out from the roll and be set correctly to be clamped between the film transporting belts. Especially if a film must be manually moved into a storage space or set between the film transporting belts, it becomes wrinkled easily if the tension thereon is reduced and its handling becomes even more difficult. In summary, prior art film supplying apparatus are difficult to use and their workability is disappointingly poor.

It is therefore an object of this invention to provide a film supplying apparatus for a packaging machine which allows films to be interchanged automatically such that the general workability of the machine can be improved at the time of exchanging films.

In anticipation for occurrences of erroneous film movement, packaging machines of this type are generally provided with many sensors. Before a series of packaging operations is started, the wrinkled front edge part of the film is cut off, but the operator may forget to remove the edge part which has been cut off. Even without any negligence on the part of the operator, the stretched film piece by itself may miss and fail to catch the tray which is lifted up by the lift. In such a situation, the film may be transported farther beyond the packaging station toward its downstream side, becoming wound around and caught below the end parts of the film transporting belts. Such an "overrun" situation of the film is detected by an overrun detection sensor adapted to detect the presence of the film where it normally should not be, such that the film transporting belts and other film supplying means can be stopped as soon as such an abnormal situation is detected. It has also been known to provide a film detector on the upstream side of the film transporting belts for stopping the belts and other film supplying and driving means as soon as it is detected that the film roll has run out of the film or that the film supply to the film transporting belts has been interrupted, for example, because the film has been caught around a supply roller.

If two film storage spaces are provided on both sides of the film transporting belts, as explained above, and if the direction of motion of the film transporting belts is made switchable, however, it becomes necessary to provide overrun detection sensors and film detection sensors of the kinds described above at both ends of the belts. In other words, the total number of detectors will have to be doubled. This affects not only the cost of the parts but also the labor required to install these extra sensors.

It is therefore another object of this invention to provide a film supplying apparatus for a packaging machine which uses each of its sensors both as an overrun detection sensor and as a film detection sensor, depending on the direction in which the film is supplied to the packaging station, such that the total number of sensors does not have to be increased although the film transporting belts may be movable in two opposite directions.

The lift for lifting trays of different sizes usually comprises a vertically movable base member provided with a plurality of posts adapted to hold a tray thereon. Since trays come in different sizes, however, it is desirable to be able to vary the separations among the posts according to the size of the tray to be lifted. For example, their separations should be increased for a larger tray so that it can be carried stably, and they should be brought closer together in the case of a smaller tray because a narrower film will be used for wrapping a smaller tray and the film transporting belts on both sides are brought closer together, making it necessary to prevent collisions between the film transporting belts and the peripheral posts.

In order to make the separations changeable among the posts, it has been known to attach the posts slidably onto the base member. From the point of view of workability, it has also been known to provide sliders by means of which the posts can be moved horizontally and their density per area can be controlled, but these sliders must be able to move the posts in all and mutually opposite directions. This results in a different problem of alignment and engagement between the sliders and the posts. After a periodic cleaning of the apparatus as a part of its maintenance work or occurrence of an abnormal situation, furthermore, the movable posts are probably found at random positions. It is then a problem to be considered how efficiently one can rearrange randomly positioned posts by bringing them to specified positions.

It is therefore still another object of this invention to provide a lift mechanism for a packaging machine capable of easily and efficiently move its posts horizontally.

SUMMARY OF THE INVENTION

Film supplying apparatus embodying this invention, with which some of the above and other objects can be accomplished, may be characterized as comprising film transporting belts which extend longitudinally between a first end position and a second end position and are capable of clamping both side edges of a film and moving the clamped film selectively in either longitudinal direction, storage spaces storing two film rolls therein, a pair of film guiding mechanisms each capable of pulling a film out of an associated one of the film rolls and guiding the film to an associated one of the end positions of the film transporting belts, and a controller which is adapted, when the film transporting belts are in motion, to selectively activate one of these film guiding mechanisms that is on the upstream side of the motion.

Each of these film guiding mechanisms may include film guiding belts serving to transport the film to the associated one of the end positions of the film transporting belts, a clamping mechanism capable of clamping edges of the film, and a retracting mechanism for lowering the film guiding belts to a lowered position so as to contact the film when the film guiding mechanism is in operation and lifting the film guiding belts to a retracted position above the film transporting belts while the film remains clamped by the clamping mechanism when the film guiding mechanism is not in operation.

When a new film is to be used on a film supplying apparatus thus structured, the direction of motion of the film transporting belts is switched such that the film roll to be used is on the upstream side of the belts. As soon as this is done, the controller activates the film guiding mechanism on the upstream side of the belts, and the film guiding mechanism on the downstream side is deactivated. Thus, no manual labor is required to remove the film which is not being used or to feed a new film to the film transporting belts whenever trays of a different size are to be packaged.

If the film guiding mechanisms are structured as described above, furthermore, whichever of the film guiding mechanisms to be activated is brought down to a lowered position in contact with the film. The film guiding mechanism which is not activated is lifted to a retracted position separated from the film transporting belts while the film remains clamped. Thus, the film to be used is forcibly guided by the film guiding belts to the film transporting belts while the film not to be used are retracted away from the film transporting belts so as to be prevented from erroneously approaching the film transporting belts.

Film supplying apparatus of this invention may be further characterized as having switching means for switching the direction of film transportation by the film transporting belts and sensors for detecting presence or absence of a film, a first group of the sensors being disposed at one end (or "the first end") of the film transporting belts, a second group of the sensors being disposed at the other end (or "the second end") of the film transporting belts. A controller switches the roles of the first group and the second group of sensors, depending on the direction of film transportation by the film transporting belts such that the first group of sensors serves to output a warning signal when the film is detected thereby and the second group of sensors serves to output a warning signal when the absence of film is detected thereby if the direction of film transportation by the film transporting belts is from the second end to the first end, and that the first group of sensors serves to output a warning signal when the absence of film is detected thereby and the second group of sensors serves to output a warning signal when the film is detected thereby if the direction of film transportation by the film transporting belts is from the first end to the second end. In other words, each of the sensors is used alternatively as an overrun detection sensor for detecting an overrun condition or as a film detection sensor for detecting an interruption in the supply of the film to the film transporting belts. According to a preferred embodiment of the invention, the first group and the second group each include two sensors, each disposed on opposite transverse side of the film transporting belts. In other words, there will be a total of four such sensors.

With a film supplying apparatus thus structured, each sensor, disposed at one of the end positions of the film transporting belts, plays two roles, depending upon the direction of film transportation by the belts. As a result, the total number of sensors for detecting both an overrun condition of the film, which occurs on the downstream end of the belts, and an interruption in the supply of film, which occurs on the upstream end of the belts, need not be doubled although the direction of film transportation by the belts is switchable between two directions. Thus, the cost of the parts and the labor cost of their installation are not increased according to this invention. If the sensors are provided on both transverse sides of the belts, abnormal conditions are more dependably detected.

A lift mechanism embodying this invention, with which some of the aforementioned and other objects can be accomplished, may be characterized as comprising a frame, a frame-lifting mechanism for moving the frame selectively upward or downward, a plurality of posts standing on the frame for supporting trays thereon, some of the posts being fixed posts, which are affixed to the frame, and the others being mobile posts, which can move in a specified direction within a specified range each towards or away from associated one of the fixed posts, a slidable member extending perpendicularly to that specified direction and capable of sliding in the specified direction beyond the specified range, and a controller for stopping the slidable member at a plurality of stop positions within the specified range and wait positions which are outside the specified range and causing the slidable member and the mobile posts to move towards or away from each other to any of the stop positions. According to a preferred embodiment, the lift mechanism will further include a plurality of sensors each for outputting a detection signal for detecting the slidable member and a non-detection signal for not detecting it. These sensors are disposed in the specified direction such that a combined pattern of these detection signals changes differently at each of the stop positions. The controller causes the slidable member to stop when the pattern of detection signals changes.

With a lift mechanism thus structured, all of the mobile posts can be moved simply by moving the single slidable member. Since the slidable member pushes the mobile posts sideways only in one direction, there is no need for alignment or engagement between the slidable member which pushes and the mobile posts which are pushed. Since the mobile posts can be moved to two or more different stopping positions within a specified range, the distance between pairs of associated fixed and mobile posts can be changed accordingly such that trays of various sizes can be dependably supported thereon for lifting. Since the slidable member can be moved to wait positions beyond the specified range for the mobile posts, the mobile posts can be dependably pushed by the slidable member even when they are at random positions such as after a periodic maintenance work.

With the sensors adapted to output detection and non-detection signals as described above, the total number of the sensors is less than the number of stop and wait positions because the controller responds to the combined pattern of signals from the individual sensors. In other words, fewer sensors are required to stop the slidable member at the stop and wait positions according to this invention.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings.

DETAILED DESCRIPTION OF THE INVENTION

Figure 1:
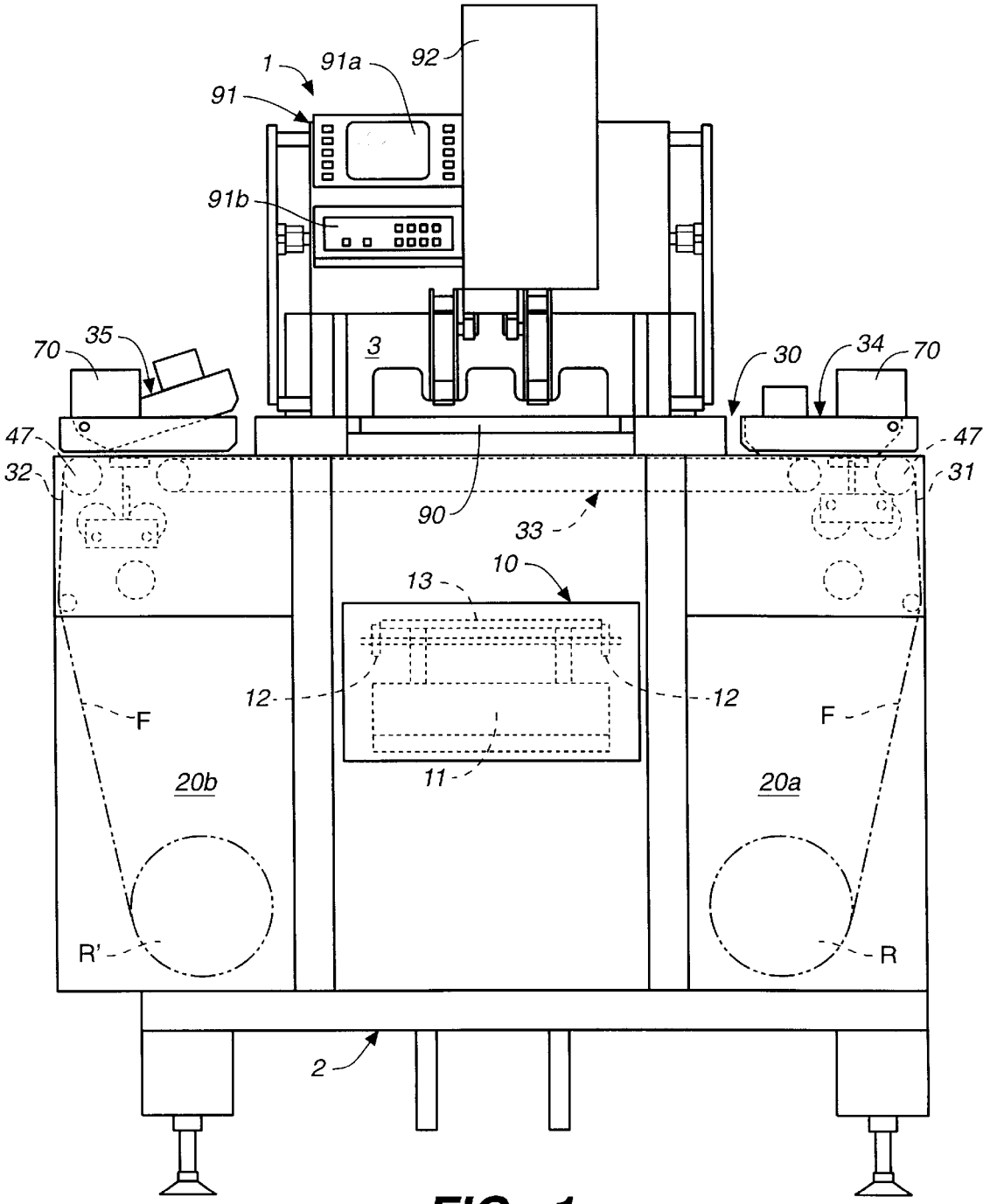
FIG. 1 is a front view of a packaging machine incorporating a film supplying apparatus embodying this invention.
Figure 2:
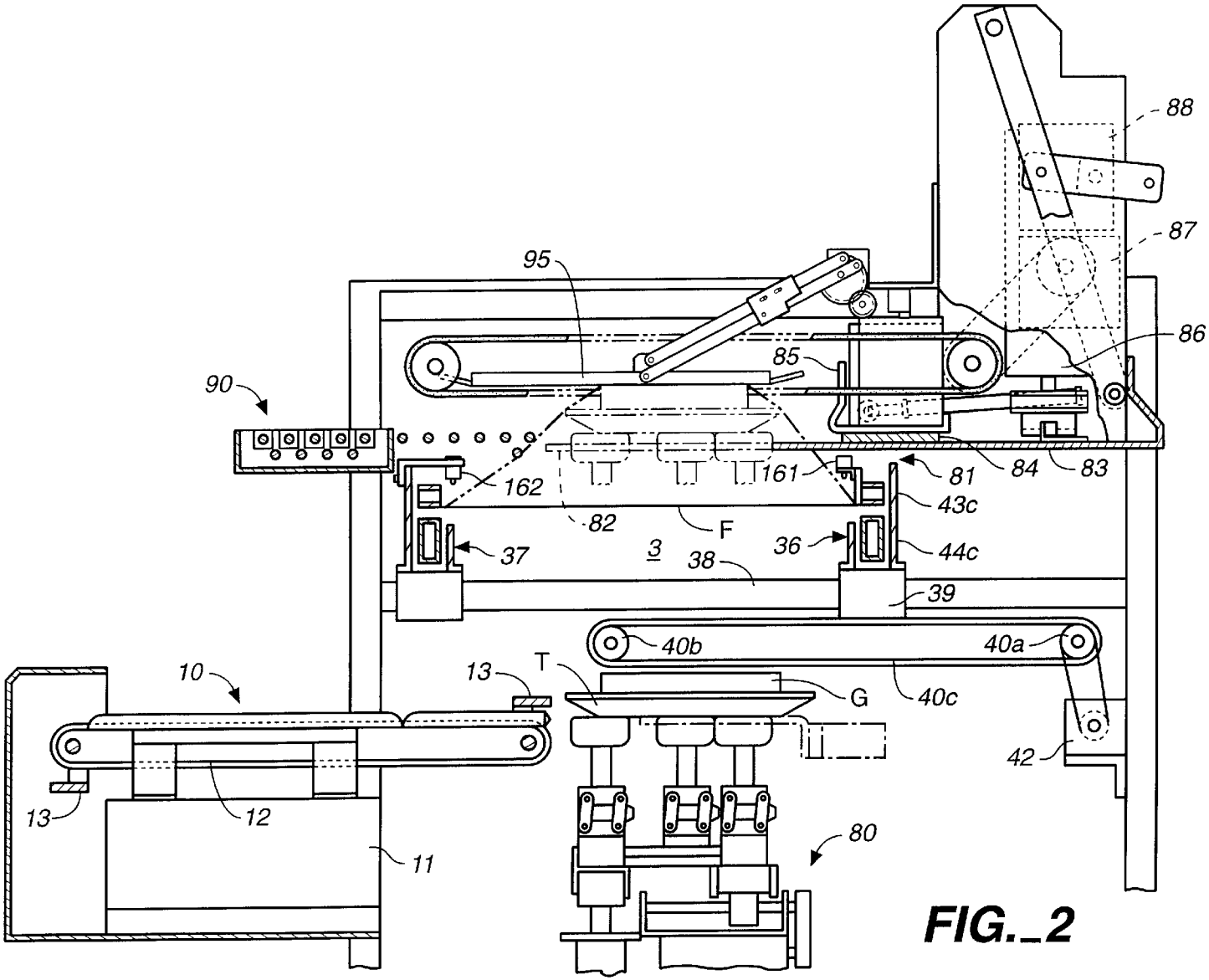
FIG. 2 is a partly sectional side view of the packaging machine of FIG. 1.
Figure 3:
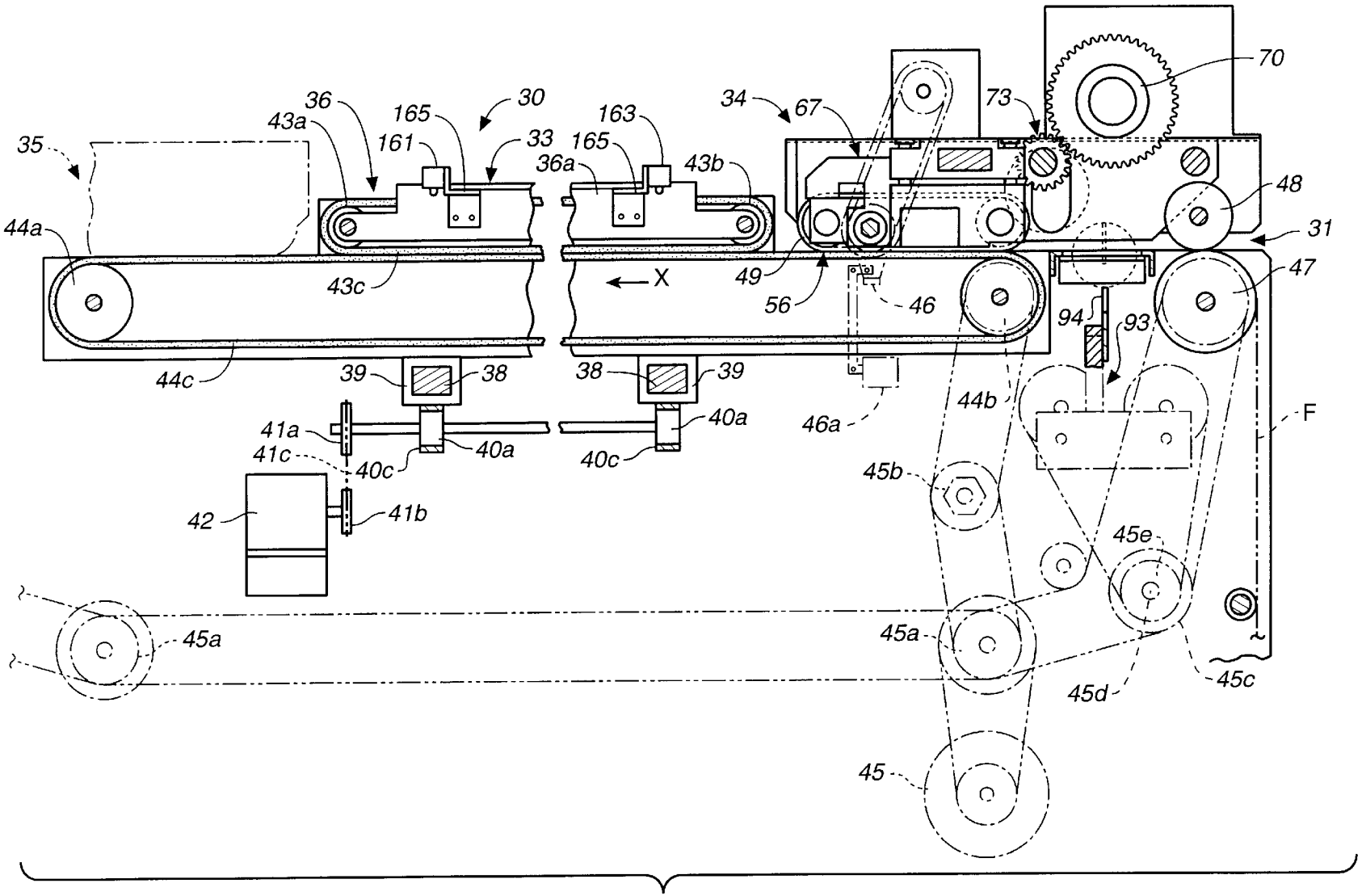
FIG. 3 is a sectional front view of the film supplying apparatus in the packaging machine of FIG. 1 with a portion thereof removed.

In what follows, the present invention is described by way of an example. FIGS. 1, 2 and 3 show an exemplary packaging machine 1, characterized as comprising a weighing apparatus 10 disposed at the center in front of its main body 2, storage spaces 20*a*, 20*b* at both side sections of the main body 2, a film supplying apparatus 30 for catching a film F pulled out from either of film rolls R, R' with different widths stored respectively in the storage spaces 20*a*, 20*b* and transporting it to a packaging station 3 inside the main body 2, a lift 80 for lifting a target object G (such as fresh foods to be made into a package) inclusive of a tray T brought in from the weighing apparatus 10 and pushing it up from below the film F being held in a stretched condition at the packaging station 3, a folding apparatus 81 for wrapping up the lifted object G in the film F, and a sealing apparatus 90 disposed in front of the packaging station 3 and above the weighing apparatus 10 for thermally sealing the parts of the film F folded towards the bottom surface of the tray.

Above the main body 2 is a console 91 including a display part 91*a* and an input station 91*b*. A main control unit (to be described in detail below) inside the console 91 serves not only to control the operations of the weighing apparatus 10, the film supplying apparatus 30, the lift 80 and the folding apparatus 81 but also to calculate the price of the packaged product on the basis of a signal indicative of the weight of the packaged target object G measured by the weighing apparatus 10 (exclusive of the weight of the film). An automatic labeler 92 is disposed above the folding apparatus 81 for printing data such as the weight and price of the product based on a signal outputted from the console 91 and also automatically attaching the issued label to the packaged product on the sealing apparatus 90.

Broadly described, the film supplying apparatus 30 includes a pair of film pulling mechanisms for catching and pulling a film F from the roll R or R' stored in the storage spaces 20*a*, 20*b*, a film transporting mechanism 33 for transporting the film F to the packaging station 3 at the center, and a pair of film guiding mechanisms 34, 35 for guiding the film F pulled out of the film pulling mechanisms 31, 32 selectively to the film transporting mechanism 33. As shown in FIG. 2, the film transporting mechanism 33 includes a mobile transportation unit 36 for transporting the film F from the film pulling mechanism 31 or 32 by clamping one of its side edges (the right-hand side edge in FIG. 2) and a fixed transportation unit 37 for transporting the film F by clamping the other of its side edges (the left-hand side edge in FIG. 2).

With reference to both FIGS. 2 and 3, two guide rods 38 are provided below the mobile and fixed transportation units 36, 37 with both ends supported by the main body 2. Supporting blocks 39, which are each engaged with corresponding one of these guide rods 38 slidably therealong, are attached to the bottom surface of the mobile transportation unit 36. Below the mobile transportation unit 36, there is a timing belt 40*c* stretched between a pair of timing pulleys 40*a*, 40*b* along these guide rods 38. One of the pairs of timing pulleys (40*a*) is attached to a sprocket 41*a* in a motion-communicating relationship through a chain 41*c* with another sprocket 41*b* attached to the drive shaft of an interval-adjusting motor 42. The aforementioned supporting blocks 39 are each affixed to the upper surface of the chain 41*c* such that, as the interval-adjusting motor 42 is activated and rotated in an appropriate direction, the pair of supporting blocks 39 is caused to slide along the guide rods 38 and the mobile transportation unit 36 as a whole is caused to move either towards or away from the stationary transportation unit 37, which is affixed to the main body 2 at one end of the guide rods 38. Since the mobile and stationary transportation units 36, 37 are structured similarly in other respects, the structure of only the mobile transportation unit 36 will be further described next.

The mobile transportation unit 36, as shown in FIG. 3, includes an upper film transporting belt 43*c* and a lower film transporting belt 44*c*, which are both a timing belt and stretched in the direction of transportation of the film F respectively between a pair of timing pulleys 43*a*, 43*b* rotatably supported at opposite upper end parts of the main frame 36*a* and between another pair of timing pulleys 44*a*, 44*b* also rotatably supported at opposite end parts of the main frame 36*a* but below the upper film transporting belt 43*c*. The timing pulley 44*b* (on the right-hand side in FIG. 3) is driven by a belt-driving motor (switch means) 45 adapted to rotate in both positive and negative directions and provided with a brake, such that the direction of transportation of the film F by the lower film transporting belt 44*c* can be switched by properly selecting the direction of rotation of the belt-driving motor 45. In other words, if the belt-driving motor 45 is rotated, for example, in the counter-clockwise direction, the film F which is clamped between the lower and upper film transporting belts 44*c*, 43*c* is transported towards the packaging station 3. During this process, the lower and upper film transporting belts 44*c*, 43*c* are disposed so as to be in a mutually tightly contacting condition such that one of the side edges of the film F is securely clamped therebetween. The motion communicating system for communicating the motion of the belt-driving motor 45 to the timing pulley 44*b* includes a decelerating pulley 45*a* and a mobile pulley 45*b* adapted to be displaced as its distance from the mobile transportation unit 36 is adjusted.

The fixed transportation unit 37, structured similarly to the mobile transportation unit 36, is also capable of moving its lower film transporting belt 44*c* by the belt-driving motor 45 such that the direction of transportation of the film F can be switched. The other edge of the film F is securely clamped between its lower and upper film transporting belts 44*c*, 43*c*.

The pairs of film pulling mechanisms 31, 32 and film guiding mechanisms 34, 35 are longitudinally on opposite sides of this film transporting mechanism 33. Since the mechanisms of each of these pairs are structured substantially identically, only one of each pair will be described below.

As shown in FIG. 3, the film pulling mechanism 31 (the one on the right-hand side in FIG. 1) is provided with a pull-out roller 47 and a compression roller 48. The pull-out roller 47 is driven by the belt-driving motor 45 and is adapted to catch the film F and pull it out of a film roll R (shown in FIG. 1). The compression roller 48 is for clamping the film F with the pull-out roller 47. The film guiding mechanism 34 is disposed between the corresponding film pulling mechanism 31 and the mobile transportation unit 36 and can swing vertically upward and downward. Broadly described, the film guiding mechanism 34 includes guiding belts 49, a clamping mechanism, a retracting mechanism and an interval adjusting mechanism (all to be described more in detail below). The guiding belts 49 are adapted to sandwich both side edges of the film F with the aforementioned lower film transporting belts 44*c* and to guide the film F to the upper surface at the upstream end part of the lower film transporting belts 44*c* while rotating therewith. The clamping mechanism is disposed at the downstream end of the guiding belts 49 for clamping an edge of the film F. The retracting mechanism serves to lower the guiding belts 49 to its lower position, while the film guiding mechanism 34 is in operation, so as to be in contact with the upper surface of the lower film transporting belts 44*c* and to raise them to an upper retracted position above the lower film transporting belts 44*c* while the clamping mechanism continues to clamp the edges of the film F, when the film guiding mechanism 34 is not in operation. The interval adjusting mechanism is a mechanism for adjusting the separation between the two guiding belts 49 by holding the guiding belt 49 corresponding to the mobile transportation unit 36 adjustingly according to the width of the film F being used.

As shown in FIG. 3, the film guiding mechanism 34 is set at its film guiding position such that its guiding belts 49 are in contact with the lower film transporting belts 44*c*. If the belt-driving motor 45 is rotated in the counter-clockwise direction under this condition, the edge of the film F pulled out from the pull-out roller 47 is delivered through the film guiding mechanism 34 to both the mobile and stationary transportation units 36, 37. The film F is thereby clamped on both its side edges and transported to the packaging station 3.

A perforator 93, for making perforations transversely across the film F, is provided between the film pulling mechanism 31 and the film guiding mechanism 34. A compressing member 46 is provided below the film guiding mechanism 34, being adapted to be driven by a solenoid 46*a* and to thereby compress the film F against the film guiding mechanism 34 while pushing the latter upward a little. The perforator 93 includes a cutter 94 disposed between the pull-out roller 47 and the guiding belts 49 and adapted to move vertically upward and downward in synchronism with the operation of the pull-out roller 47. Shortly after the film F is perforated by the perforator 93 and is introduced into the film transporting mechanism 33, the pull-out roller 47 is stopped when the line of perforations has passed the compressing member 46. At the same time, the guiding belts 49 are lifted by the compressing member 46 to compress the film F. The film F is thereby severed along the line of perforation at the downstream end position of the guiding belts 49 and the film piece of a specified length, thus severed, is transported to the packaging station 3, while the front edge of the remaining film F continues to be held at a specified wait position between the lower film transporting belts 44*c* and the guiding belts 49.

According to the embodiment shown in FIG. 3, the belt-driving motor 45 for the lower film transporting belts 44*c* is used also for driving the pull-out roller 47 and the cutter 94. The pull-out roller 47 is provided with clutch brake and is adapted to be driven by a belt through a decelerating pulley 45*a* and an idler 45*c*, while the operating mechanism for the cutter 94 is driven by a belt through a pulley 45*e* with clutch brake attached to the idler shaft 45*d* of the idler 45*c*. Thus, the operation and stopping of the pull-out roller 47 and the cutter 94 can be carried out at any desired timing by controlling the pull-out roller 47 and the pulley 45*e*, both with a clutch brake.

Below the packaging station 3 is the lift 80, as shown in FIG. 2, for receiving an object G to be packaged, such as fresh food on a tray T, from the weighing apparatus 10 and lifting it to the packaging station 3. Directly above the film F is the folding apparatus 81 for folding front, back and side edge parts of the film F towards the bottom surface of the tray T to thereby wrap up the object G inclusive of its tray T.

The weighing apparatus 10 includes a weighing device 11 for weighing the object G carried on the tray T and a pair of transporting belts 12. As the object on the tray T is placed on the weighing device 11, the weight of the object G is thereby measured together with the tray T, and the tray T, while carrying the object G thereon, is transported onto the lift 80 by means of a pusher 13 placed across the belts 12 as the belts 12 are being driven.

As shown by broken lines in FIG. 2, the tray T is lifted by the lift 80 and pushes the film F upwards from below such that the film F is pressed against the upper surface of the object G while both side edges of the film F remain clamped between the upper and lower film transporting belts 43*c*, 44*c* of the mobile and stationary transportation units 36, 37 so as to keep the film F in a transversely stretched condition.

As shown in FIG. 2, the folding apparatus 81, which serves to thereafter package the object G together with the tray T, includes a pair of side folding plates 82, 83 disposed transversely opposite to each other with respect to the film F, a back folding plate 84 disposed above the side folding plates 82, 83 and in the direction of the film F, and a discharge pusher 85 disposed above the back folding plate 84. Driven by a driving motor 86, the side folding plates 82, 83 move in the direction of transportation of the film F towards or away from each other. Driven by another driving motor 88, the back folding plate 84 moves in one direction and the opposite direction transversely. The discharge pusher 85 is driven by a pusher-driving motor 87 to move transversely in one direction or the other with respect to the film F. After these folding plates 82, 83, 84 fold the edge parts of the film F, stretched as shown by dotted lines in FIG. 2, towards the bottom surface of the tray T, the discharge pusher 85 moves forward to push the object G together with the tray T towards the sealing apparatus 90 where the folded edge parts of the film F are thermally sealed.

In FIG. 2, numeral 95 indicates a device disposed above the packaging station for pushing down the articles being packaged in order to prevent it from rising too high.

Next, the structure of the film supplying apparatus according to this invention will be described more in detail with reference further to FIGS. 4–7.

As explained above briefly, the belt-driving motor 45, capable of rotating selectably in either direction, serves both the mobile and fixed transportation units 36, 37 of the film transporting mechanism 33, and the direction of motion of the film F can be switched by changing the direction of rotation of this motor.

As shown in FIG. 3, the lower film transporting belt 44*c* is longer than the upper film transporting belt 43*c* and extends farther outward at both their end parts, and the pull-out rollers 47 are disposed on both sides of the lower film transporting belt 44*c*. As shown in FIGS. 1 and 4–7, pairs of support plates 50 are disposed symmetrically both at forward and backward positions on both end parts of the main body 2, standing above both the lower film transporting belt 44*c* and the pull-out rollers 47. The compression rollers 48 are each rotatably supported between one of the pairs of these support plates 50. A pair of rotatable frames 51, each having an inverse L-shape and a collar part 51*a* on its upper portion, is rotatably supported by each pair of the support plates 50 around a shaft 52 above the compression roller 48. An elongated guide member 53 extends between the pair of rotatable frames 51 above the lower film transporting belt 44*c*, and a fixed block 54*a* and a slidable block 54*b* are engaged with the guide member 53. A film introducing structure 55 having one of the aforementioned guiding belts 49 is supported below the fixed block 54*a*, and another film introducing structure 56 having the other of the guiding belts 49 is supported below the slidable block 54*b*. The interval between the two film introducing structures 55, 56 can be adjusted according to the width of the film F to be used by moving the slidable block 54*b* along the guide member 53.

Since the two film introducing structures 55, 56 are similarly structured, only the film introducing structure 56 supported by the slidable block 54*b* will be described next.

Figure 4:
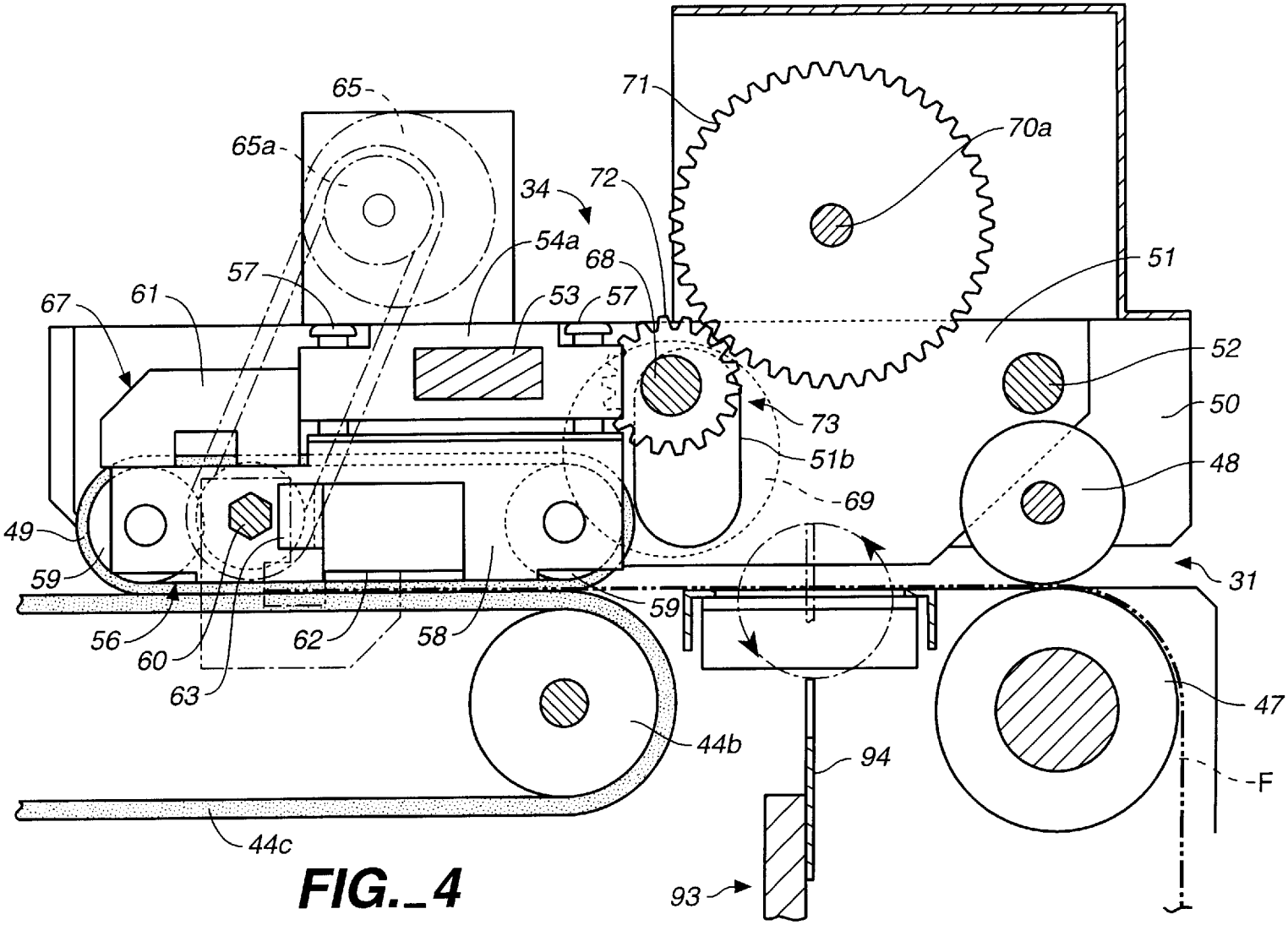
FIG. 4 is a sectional side view of a portion of the film supplying apparatus of FIG. 3.
Figure 5:
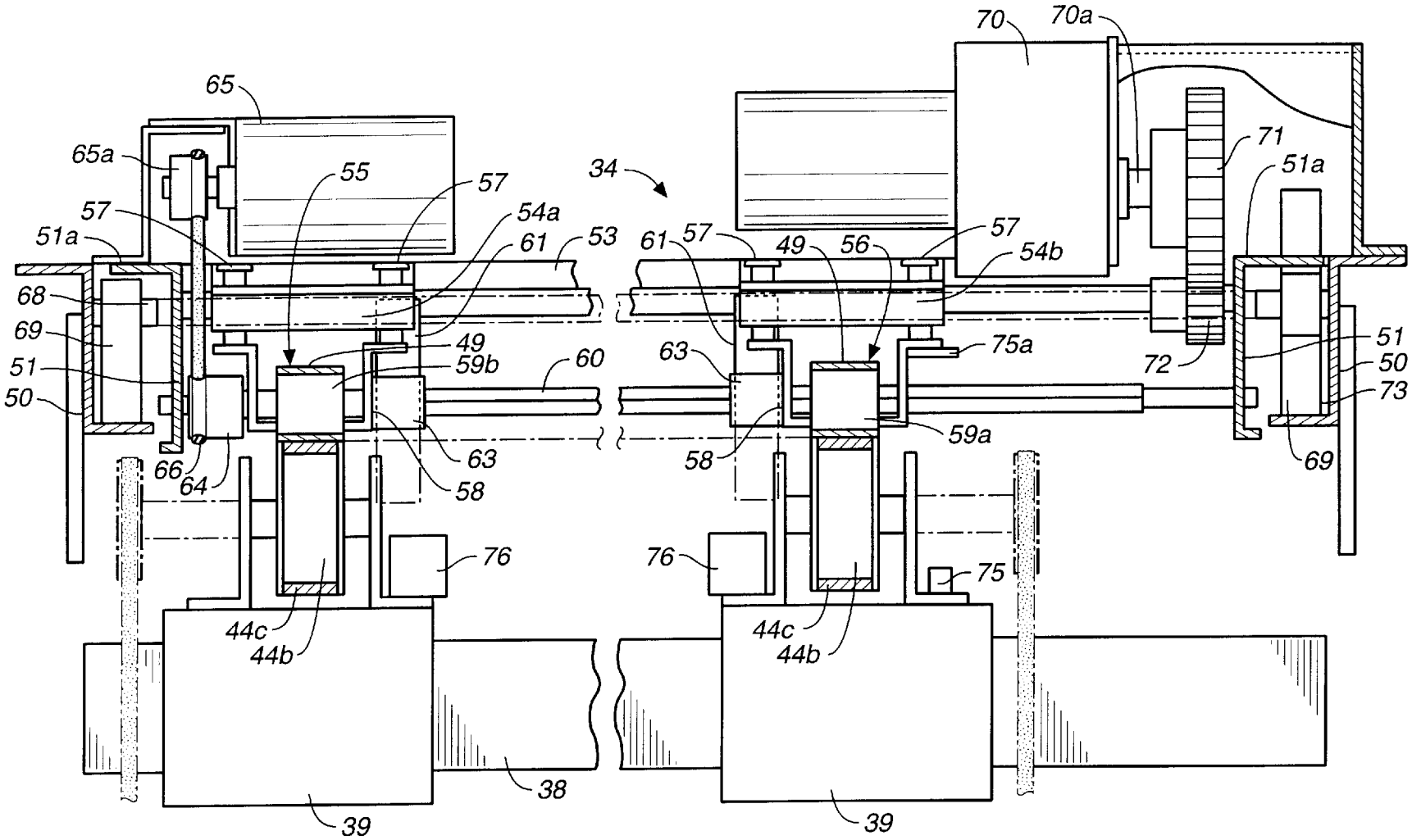
FIG. 5 is a sectional side view of the film guiding mechanism of FIG. 4.

As shown in FIGS. 4 and 5, the film introducing structure 56 comprises a support frame 58 elongated in the direction of motion of the film F, a pair of pulleys 59 (or 59*a*, 59*b*) rotatably supported on both end parts of the support frame 58 and one of the guiding belts 49 stretched between these pulleys 59*a*, 59*b* in the direction of motion of the film F. The support frame 58 has a collar and is cross-sectionally U-shaped and supported by a plurality of support rods 57 so as to be movable vertically upward and downward within a limited range. As shown in FIG. 4, the guiding belts 49 associated with these two film introducing structures 55, 56 are disposed at positions corresponding to the upper surface of an end part of the lower film transporting belt 44*c*. When they are at a film guiding position, they are in contact with the lower film transporting belt 44*c* due to the gravitational force thereon and are rotated by the rotary motion of the lower film transporting belt 44*c* such that the film F sandwiched between the guiding belt 49 and the lower film transporting belt 44*c* is introduced between the upper and lower film transporting belts 43*c*, 44*c*.

Figure 6:
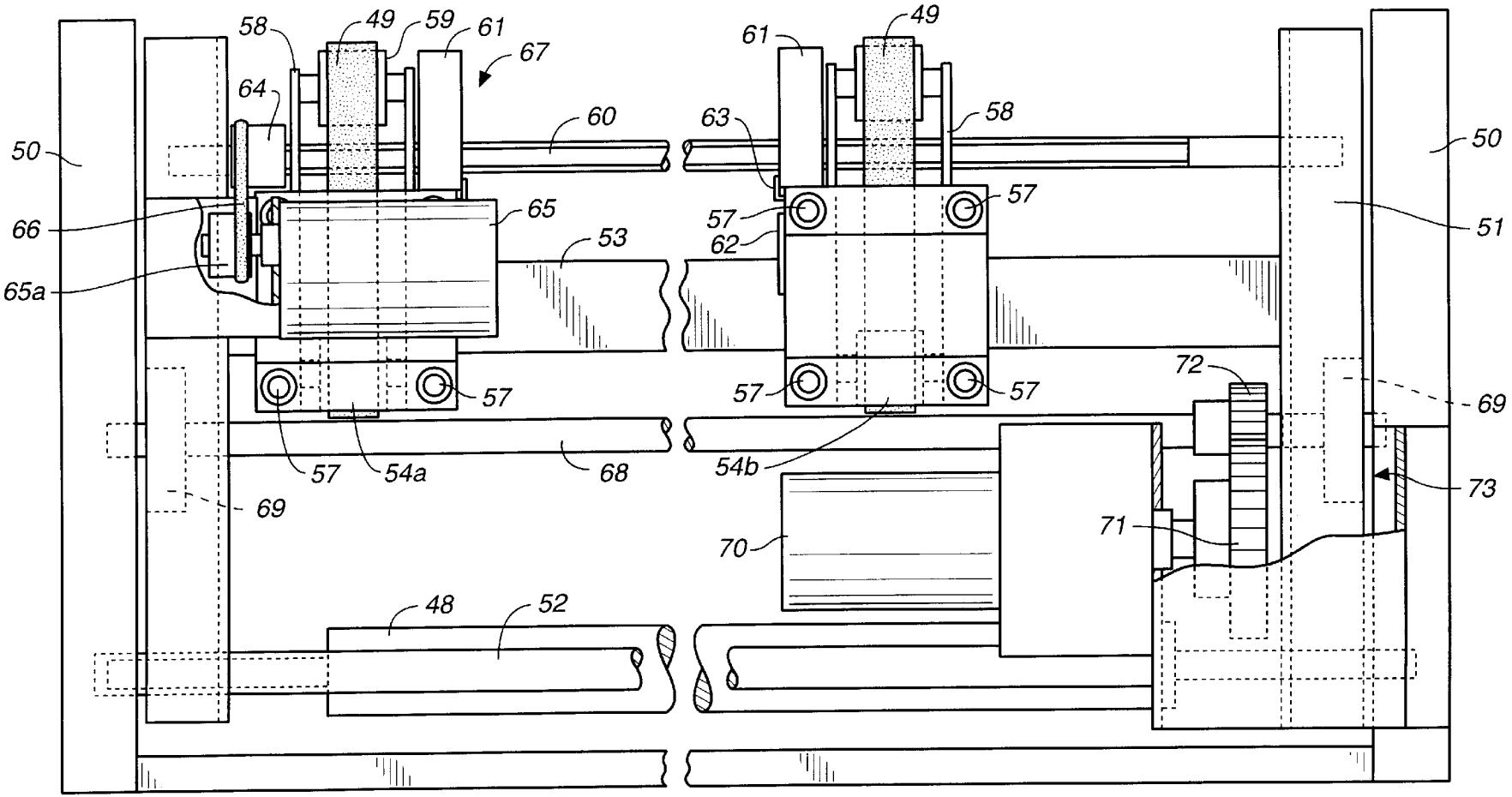
FIG. 6 is a plan view of a portion of the film guiding mechanism of FIG. 5 with portions removed.

There is a rod 60 supported rotatably by the support frames 58 and the rotatable frames 51, and a pair of clamping members 61 is supported by the rod 60 between the support frames 58. A backing plate 62 protrudes inwardly from each of the support frames 58 such that, when the clamping members 61 are rotated with the rod 60 to the clamping position shown by dotted line in FIG. 4 (and by solid line in FIG. 7), the film F is clamped between end surfaces distal from the rod 60 of the clamping members 61 and the bottom surface of the backing members 62. The clamping members 61 are supported by support pieces 63 on the support frames 58 such that the clamping member 61 on the right-hand side as shown in FIG. 6 can slide along the rod 60 with the support frame 58 associated with the slidable block 54*b*.

A follower pulley 64 is provided on the rod 60 between the rotatable frame 51 and the support plate 50 on the side of the fixed block 54*a*, and a clamping motor 65, which can rotate selectably in either direction and is provided with a driver pulley 65*a*, is set on the upper surface of the collar part 51*a* of the support plate 50 on the side of the rotatable frame 51, a motion communicating belt 66 being stretched between these pulleys 64, 65*a*. With the clamping motor 65 rotated in positive and negative directions, the clamping members 61 can be selectably moved to the non-clamping position shown by a solid line in FIG. 4 or the clamping position shown in FIG. 7 or by a dotted line in FIG. 4. The clamping mechanism thus formed is generally indicated by numeral 67.

Figure 7:
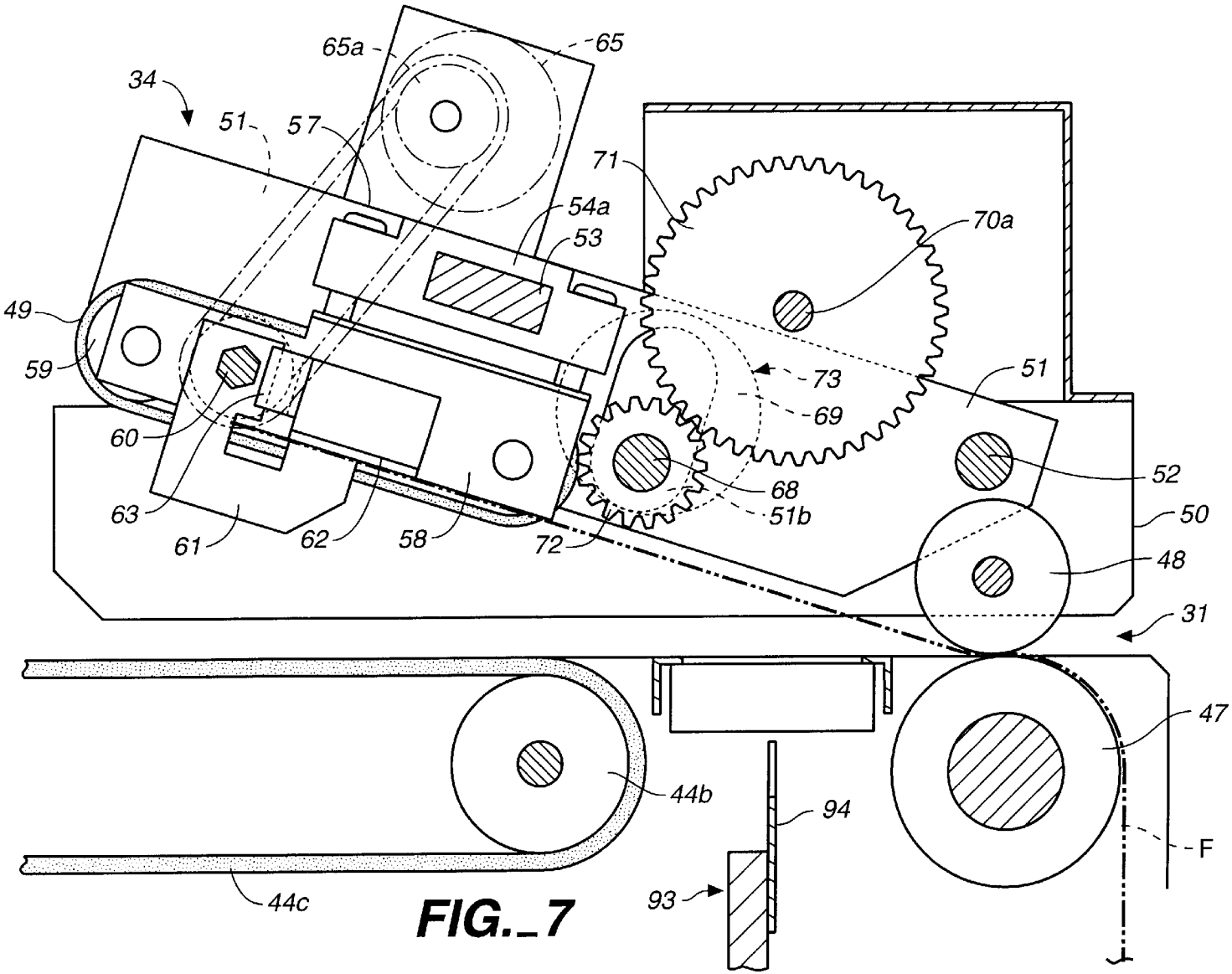
FIG. 7 is sectional front view of a portion of the film supplying apparatus of FIG. 4 with the film guiding mechanism in the retracted position.

An upwardly-downwardly elongated hole 51*b* is formed in the middle in the longitudinal direction of the rotatable frame 51, as shown in FIGS. 4 and 7. A shaft 68, rotatably supported by both of the support plates 50, penetrates the elongated holes 51*b* in both rotatable frames 51. Cams 69 are attached to both ends of this shaft 68, opposite the inner surfaces of the collar parts 51*a* of the rotatable frames 51. A cam driving motor 70 is disposed on each support plate 50 towards the back of the main body 2. A driver gear 71 affixed to the drive shaft 70*a* of the cam driving motor 70 engages a follower gear 72 such that the rotary motion of the cam driving motor 70, either in the positive or negative direction, is communicated through the driver gear 71 and the follower gear 72 to the shaft 68 and to the cams 69. The aforementioned retracting mechanism for causing the cams 69 to rotate to thereby lift the film introducing structures 55, 56 to their retracted positions above the lower film transporting belts 44*c* is indicated by numeral 73.

As shown in FIG. 5, position sensors 75 are provided at both ends of the mobile transportation unit 36 for detecting the displaced positions of the film introducing structures 56 on the side of the slidable block 54*b*. When a new film F is to be used and the aforementioned adjusting motor 42 is activated to move the mobile transportation unit 36, detection signals from these position sensors 75 are depended upon to stop the motion such that the film introducing structure 56 can be placed at a desired position.

According to the embodiment shown, optical sensors are used as the position sensors 75, with reflecting plates 75*a* positioned on one side of the support frame 58 of the film introducing structure 56. When the film introducing structure 56 and the mobile transportation unit 36 are at mutually corresponding positions with the film introducing structure 56 at the retracted position, the light from the light-emitting element of the optical sensor is reflected by the reflecting plate 75*a* and received by the light-receiving element to detect the position of the film introducing structure 56.

Ventilators 76 are provided at both end positions of the frames of the mobile and fixed transportation units 36, 37 below the clamping members 61 for preventing the film F from losing its tautness when one of the film guiding mechanisms is moved to the retracted position above the lower film transporting belt 44*c* while the film F is clamped by the clamping members 61. For this purpose, these ventilators are positioned such that the wind generated thereby will blow outward from the inside in the direction of the width of the film F. Inward slackening of the film F in the transverse direction can thus be prevented effectively, and the film F can be positioned dependably between the guiding belt 49 and the lower film transporting belt 44*c* when the film guiding systems are moved downward to the lowered position in contact with the lower film transporting belt 44*c*.

Figure 8:
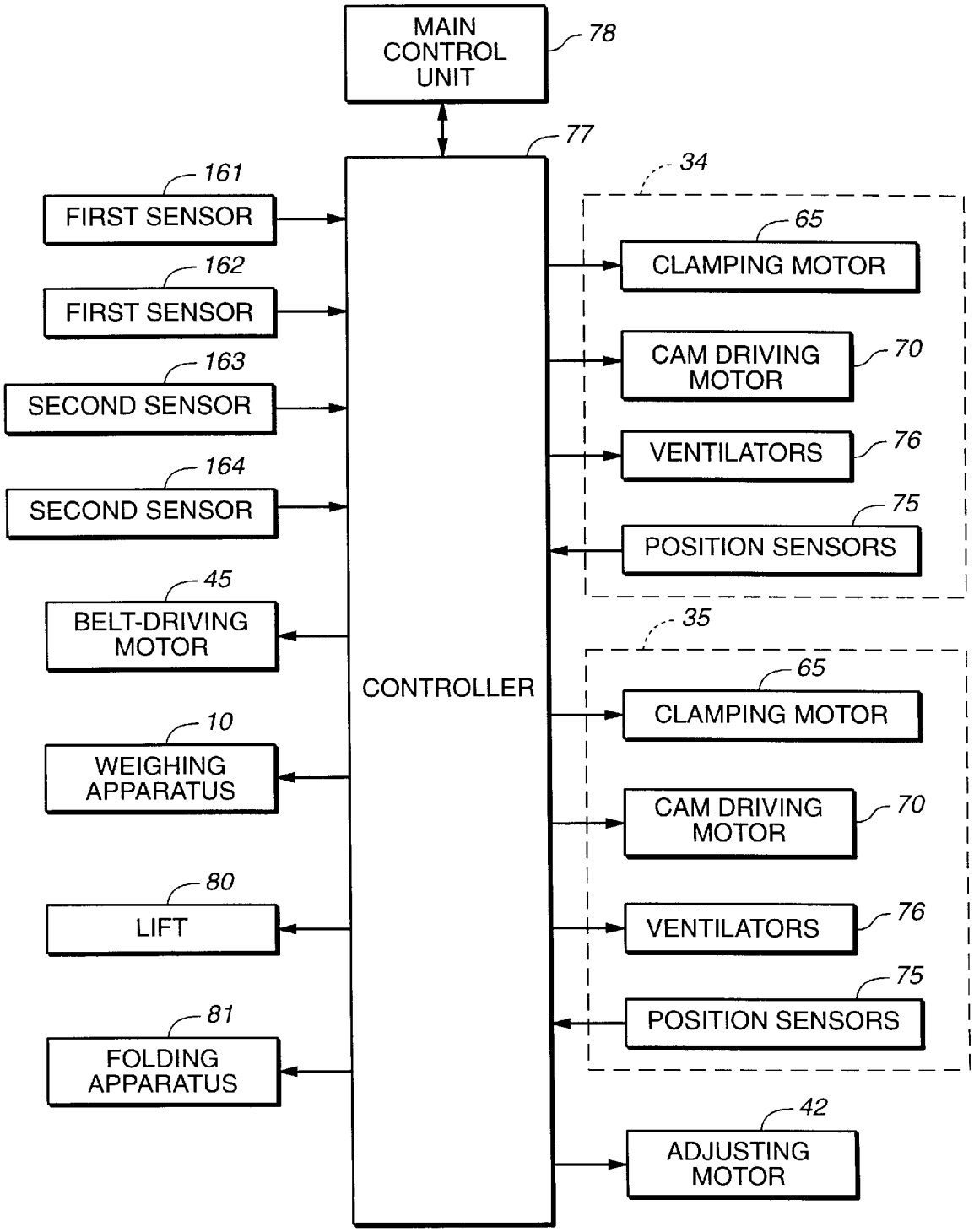
FIG. 8 is a control system diagram for the controller.

FIG. 8 is a schematic control system diagram for the film guiding mechanisms 34, 35 described above. Switch signals outputted from a main control unit 78 stored inside the console 91 and detection signals from the aforementioned position sensors 75 are received by a controller 77 which controls the clamping motors 65, the cam driving motors 70, the ventilators 76 and the adjusting motor 42 for adjusting the interval of the mobile transportation unit 36 by outputting control signals according to a preset timing.

To summarize the operations of the film supplying apparatus 30 thus structured when a new film F is to be used according to the size of the trays to be packaged, the controller 77, upon receiving a switch signal from the control unit 78 that a new film is to be used, outputs a clamp signal, a lifting signal and a ventilating signal to the film guiding mechanism (say, 34) which has been supplying a film to the packaging station 3. This causes its clamping motor 65 to be activated and the clamping members 61 to be rotated from the non-clamping position shown by solid line in FIG. 4 to the downward clamping position shown by dotted line therein so as to clamp edges of the film F between the clamping members 61 and the corresponding backing plates 62. The cam driving motor 70 is thereafter activated to rotate the pair of cams 69 through the shaft 68 and to thereby cause the rotatable frames 51 to move upward. This will move the film introducing structures 55, 56, or the film guiding mechanism 34, to the retracted position above the lower film transporting belts 44*c*. The ventilators 76 are started at about the same time as the activation of the cam driving motor 70 such that the clamped film F will not become slackened. Thus, the film guiding mechanism 34 will remain in a wait condition in the retracted position while clamping the film F to be replaced.

Now that both of the film guiding mechanisms 34, 35 are retracted upward, the controller 77 outputs to the adjusting motor 42 an interval adjustment signal such that the interval between the film introducing structures 55, 56 will be equal to the interval between the mobile and fixed transportation units 36, 37. The mobile transportation unit 36 is thereby moved along the guide rods 38 by the adjusting motor 42. Light is then emitted from the position sensors 75 corresponding to the film guiding mechanism 35 and the emitted light is reflected by the reflecting plates 75*a* at the film introducing structure 56 associated with the film guiding mechanism 35. The position of the film introducing structure 56 is thus detected by receiving the reflect light. As the detection signals outputted from the position sensors 75 are inputted to the controller 77, the controller 77 responds by stopping the operation of the adjusting motor 42 on the basis of the received detection signal. The mobile transportation unit 36 is thus automatically aligned.

The controller 77 then outputs a signal to the other film guiding mechanism 35 for supplying a new film F. In response, the cam driving motor 70 is activated to cause the cams 69 to rotate through the shaft 68. The rotatable frames 51 are thereby moved downward until the film introducing structures 55, 56 reaches the lowered positions in contact with the lower film transporting belts 44*c*. Thereafter, the controller 77 outputs a clamp release signal and a stop ventilation signal. In response, the clamping motor 65 is activated and rotates the clamping members 61 from the clamping positions shown by dotted line in FIG. 4 to the upper non-clamped position shown by solid line, thereby releasing the clamping. At the same time, the ventilators 76 are stopped. Thus, the new film F to be used is automatically sandwiched between the guiding belts 49 of the film guiding mechanism 35 and the lower film transporting belts 44*c*, and the film F is set and ready to be introduced between the upper and lower film transporting belts 43*c*, 44*c* by the operation of the lower film transporting belts 44*c*.

In summary, films can be interchanged according to this invention without manually removing the film F no longer to be used from the film transporting belt 44*c* and storing it in the storage space or setting a new film on the film transporting belts 44*c*. Thus, a new film F can be used quickly and automatically as soon as the direction of motion of the transporting mechanism is switched and the direction of film transportation is switched.

Although the invention has been described above for a situation where films with different widths are to be used, this is not intended to limit the scope of the invention. It goes without saying that the present invention is applicable equally well where films with the same width but different colors or different thicknesses are to be used.

Figure 9:
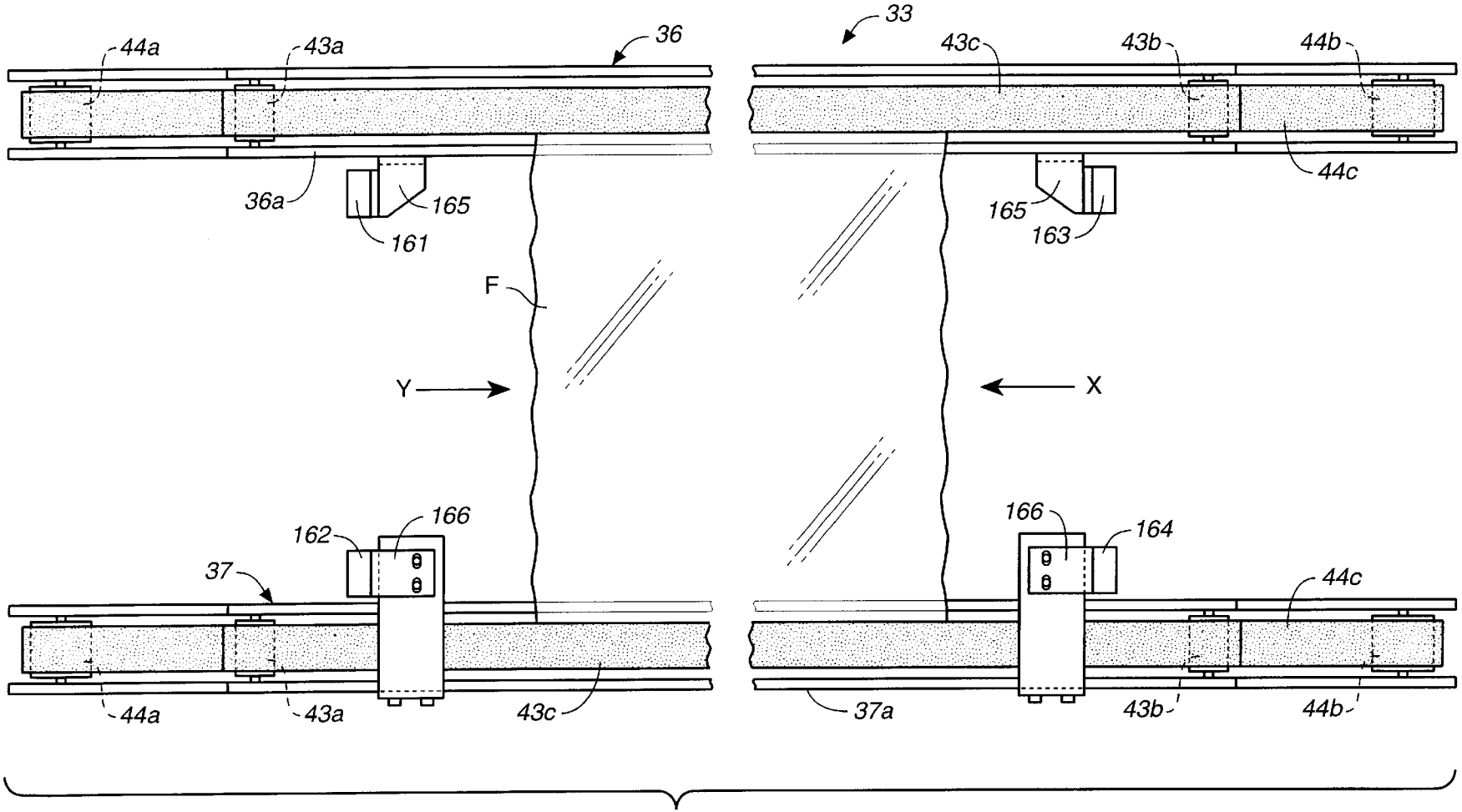
FIG. 9 is a plan view showing the attachment of sensors to the film transporting mechanism.
Figure 10:
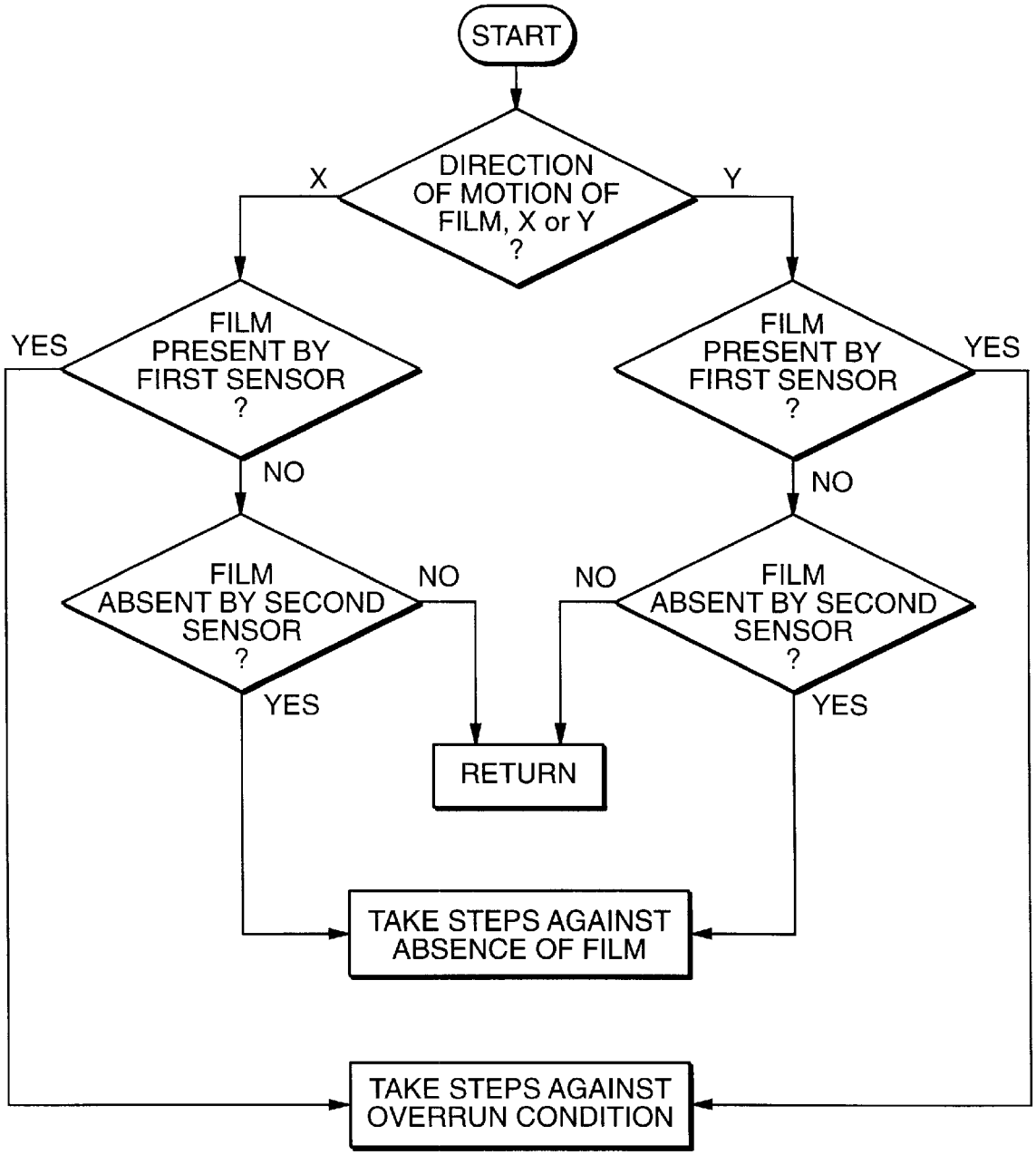
FIG. 10 is a flow chart of the control for the switching of roles of sensors, depending on the direction of transportation of the film.

With reference next to FIG. 9 as well as FIGS. 2 and 3, the film supplying apparatus 30 is also provided with a pair of film sensors 161, 162 (herein referred to as "the first sensors") disposed inside and near one end in the longitudinal direction of the upper film transporting belts 43*c* of the film transporting mechanism 33 and another pair of film sensors 163, 164 (herein referred to as "the second sensors") disposed inside and near the other end in the longitudinal direction of the upper film transporting belts 43*c*, both for detecting a side edge of the film F (or the presence of a film). As shown in FIG. 8, the aforementioned controller 77 also serves to cause whichever of the pairs of sensors 161–164 (either the first pair or the second pair) that is in the forward direction with respect to the direction of transportation of the film F by the film transporting mechanism 33 to function as overrun detection sensors and whichever of the pairs of sensors 161–164 that is in the backward direction with respect to the direction of transportation of the film F to function as film detection sensors (for detecting the absence of a film). The controller 77 further serves to switch the functions of the first and second pairs of sensors 161–164 in response to the switching of the direction of transportation of the film F by the film transporting mechanism 33. FIG. 9 shows first sensor 161 and second sensor 163 attached respectively to an attaching member 165 protruding inwardly from the main frame 36*a* of the mobile transportation unit 36 at its longitudinal end parts. Similarly, the first sensor 162 and the second sensor 164 are attached through attaching members 166 protruding inwardly from the main frame 37*a* of the stationary transportation unit 37 at its longitudinal end parts.

As explained above, the controller 77 is adapted to receive a film direction switching signal from the main control unit 78 stored inside the console 91 shown in FIG. 1, as well as film detection and non-detection signals outputted from the first and second sensors 161–164 and, based on the film direction switching signal outputted from the main control unit 78, to cause the first sensors 161, 162 positioned forwardly with respect to the direction of transportation of the film F (assumed to be as shown by Arrow X) to function as overrun detection sensors (for outputting a film detection signal) and the second sensors 163, 164 positioned backwardly to function as film detection sensors (for outputting a film non-detection signal). If the direction of transportation of the film F is switched to the Y-direction (shown in FIG. 9), the second sensors 163, 164 are now forwardly positioned and are caused to function as overrun detection sensors and the backwardly positioned first sensors 161, 162 to function as film detection sensors. The controller 77 is further adapted to output a stop signal to the belt-driving motor 45, the weighing apparatus 10, the lift 80 and the folding apparatus 81 to stop their operations when a detection or non-detection signal is received from the first sensors 161, 162 or the second sensors 163, 164.

Operations of the film supplying apparatus 30 are explained more in detail next by considering a situation, for example, wherein the size of the trays T to be wrapped up requires the film F from the film roll R to be transported in the X-direction by the film transporting mechanism 33. As this selection of the direction of film transportation is inputted by the operator from the input station 91*b* (shown in FIG. 1), the main control unit 78 outputs a switch signal to the controller 77, indicating this selected direction of film transportation. In response, the controller 77 causes the first sensors 161, 162 to serve as overrun detection sensors because they are the ones at the downstream end of the upper film transporting belts 43*c* with respect to the selected direction of transportation of the film F and the second sensors 163, 164 to serve as film detection sensors because they are at the upstream end, as shown in FIG. 9. During the process thereafter from the beginning of operations of the film transporting mechanism 33 and the film pulling mechanism 31 until the action of the film pulling mechanism 31 stops, the first sensors 161, 162 will monitor the presence of the film F. If no detection signals are outputted from the first sensors 161, 162 to the controller 77, implying that there is no overrun situation, the second sensors 163, 164 begin to check the presence or absence of the film with a time delay t equal to the time required for the edge of the film F to move from its wait position between the lower film transporting belts 44*c* and the guiding belts 49 to the position of the second sensors 163, 164 until the pullout roller 47 stops. If the second sensors 163, 164 indicate that they are detecting the film and output no non-detection signal, the controller 77 understands that the situation is normal at the upstream end and the packaging operations are continued.

If the first sensors 161, 162 detect an overrun condition of the film, whether caused by a piece of film left unremoved by an oversight or due to a disengagement of the film F at the time of packaging, the detection signals outputted thereby indicate the presence of a film where it should not be, and the controller 77, upon receiving such a signal, outputs a stop signal to all driving means such as the belt-driving motor 45, the weighing apparatus 10, the lift 80 and the folding apparatus 81 so as to stop their operations. Under this stopped condition, the overrun film is removed and the stop command from the controller 77 is released by the operator to resume the packaging operations again. If non-detection signals outputted from the second sensors 163, 164 indicate that there is no film, the controller similarly outputs a stop signal to these driving means to stop their operations and the operator can set up a new film roll R under this stopped condition and thereafter releases the stop command to resume the packaging operation.

If it is desired to switch the film rolls and to start using a different film from the other film roll R', the film transporting mechanism 33 will be operated to transport the film in the direction of Arrow Y. When this switch is communicated to the controller 77 through a switch signal, the second sensors 163, 164, which will be on the downstream side now, come to serve as overrun detection sensors and the first sensors 161, 162 on the upstream side serve as film detection sensors, as shown in FIG. 9. During the packaging process thereafter, the roles of the first and second sensors 161–164 are reversed from before the switch signal was received by the controller 77, or when the film F from the film roll R was transported in the direction of Arrow X.

In summary, both the first sensors 161, 162 and the second sensors 163, 164 can serve as overrun detection sensors and film detection sensors, depending on the direction of transportation of the film F by the film transporting mechanism 33. As a result, the total number of sensors to be required can be reduced, leading to reduction both in the material cost and in the labor cost for their installation.

According to a preferred embodiment of this invention, the control is carried out such that the front edge of the film pulled out of the pull-out roller 47 will come to the aforementioned wait position between the lower film transporting belts 44*c* and the guiding belts 49 when an overrun situation has been detected either by a first or second sensor serving as overrun detection sensor and the operator has responded by removing the unwanted piece of the film. This is such that the packaging operations can be resumed immediately after the removal of the piece.

Figure 11:
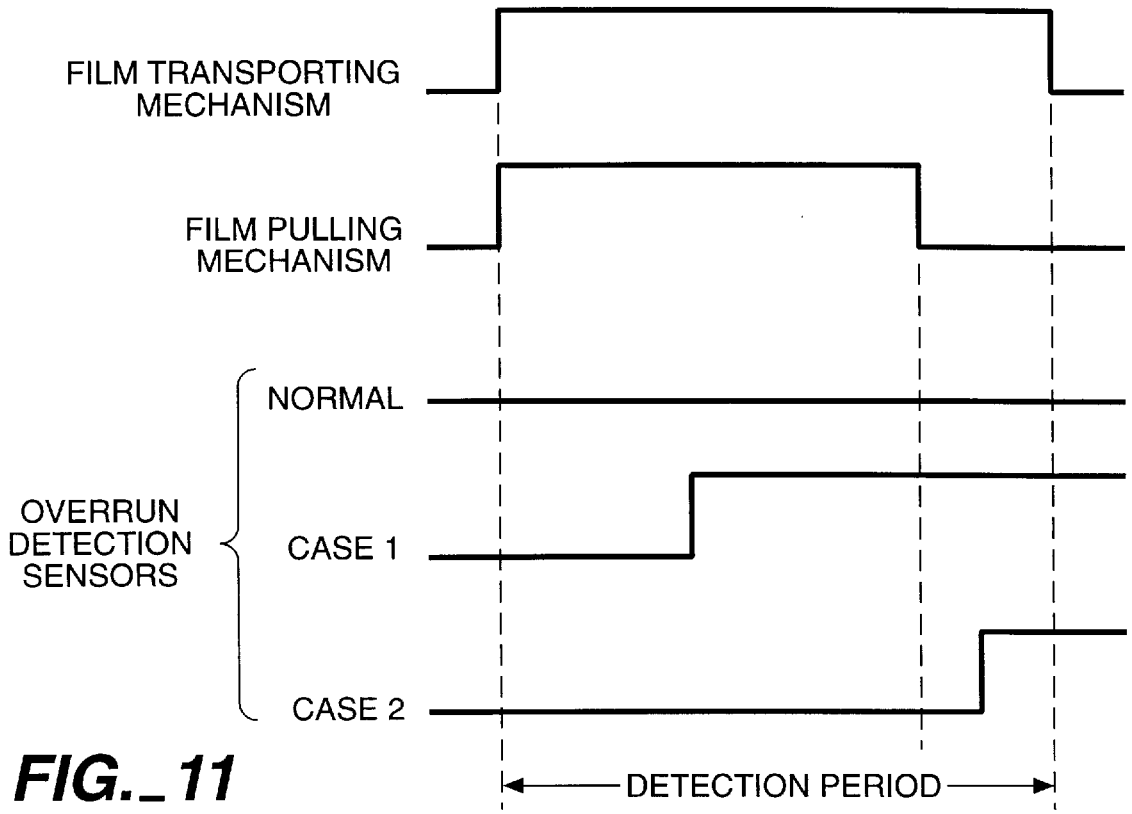
FIG. 11 is a timing chart of operations when a situation of film overrun is detected.

This is explained next more in detail with reference to the timing chart of FIG. 11. Case 1 is a situation where an overrun detection sensor (whether this happens to be a first or second sensor) detects an overrun condition before the perforations are made to the film F by the cutter 94. In this situation, the belt-driving motor 45, the lift 80, etc. are not stopped immediately, but the aforementioned pulley 45*e* with clutch brake is immediately controlled so as to form the perforations more quickly than under normal circumstances. The perforations thus formed are transported to the wait position between the lower film transporting belts 44*c* and the guiding belts 49, and the film is them torn therealong such that the front edge of the next film piece to be pulled out is exactly at the wait position. The belt-driving motor 45, the lift 80, etc. are stopped at this moment. In this manner, after the overrun portion of the film and any short piece of film which follows are removed and the stop command from the controller 77 is released, packaging operations can be resumed immediately without the necessity of taking the trouble of setting the front edge of the incoming film F at the wait position. Case 2 is a situation where an overrun condition is detected after the perforations are formed by the cutter 94. In this case, the ordinary film transportation routine is continued because the perforations have already been formed. The controller 77 stops the belt-driving motor 45, the weighing apparatus 10, etc. when the front end of the film F (along the perforations) comes to the wait position. In this situation, too, the packaging operations can be resumed immediately after the overrun portion of the film is removed and the stop command from the controller 77 is released.

It is also preferred that the control be carried out such that, when the absence (or interruption in the supply) of film is detected by film detection sensors (whether they are first or second sensors, depending on the direction of transportation of the film at the time), the operator should check if the length of the last film piece before the roll came to the end is large enough to be used for packaging.

Figure 12:
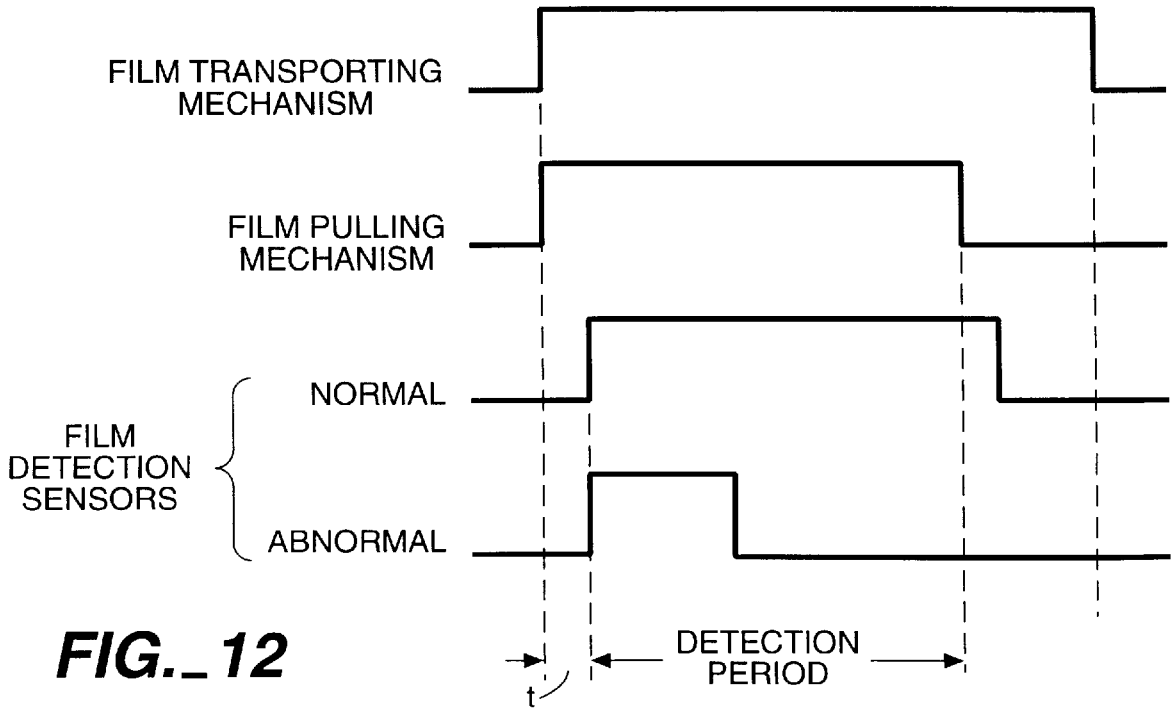
FIG. 12 is a timing chart of operations when an interruption in the supply of film is detected.

This is explained next in more detail with reference to FIG. 12. As in the case of an overrun situation described above, the operations of the belt-driving motor 45, the lift 80, etc. are not stopped immediately when the film detection sensors detect the absence (or interruption in the supply) of the film F. The detected situation is first reported to the operator through the display part 91*a* in the console 91 or a buzzer, and the operations are stopped only after the normal process of film transportation is carried out for one cycle. This enables the operator to check the last film piece which has been sent to the packaging station 3. If this piece is found to be too short for making a package, this film piece is removed from the packaging station 3 and a new film roll is set. If the last film piece is found to be only a little shorter than the specified length but long enough to make a package, a new film roll is set but the film piece is left in the normal stretched condition in the packaging station 3. The stop command from the controller 77 is then released to resume the normal packaging operations. In this manner, the last piece before the occurrence of the no-film condition is not automatically discarded, and a waste of film can be thereby avoided.

If one each of the first and second sensors 161–164 is on each side with respect to the direction of transportation of the film F, as shown in FIG. 9, an overrun situation and an absence of film can be dependably detected. Even in a situation where the film F has become disengaged on only one of the side edges, the sensors arranged as shown in FIG. 9 can detect the occurrence of an abnormality. This, however, is not to limit the scope of the invention. It is to be considered within the scope of this invention, although not separately illustrated, to provide only two sensors, one at each end of the transportation belt 43*c*, so as to further reduce the number of sensors. It is also to be noted that, although descriptions have been given above only where two film rolls R, R' with different widths are employed, the difference between the two film rolls R, R' need not be in terms of their width but in the thickness, color or design of the film.

Next, the lift 80, referenced only briefly above, will be described more in detail.

Figure 13:
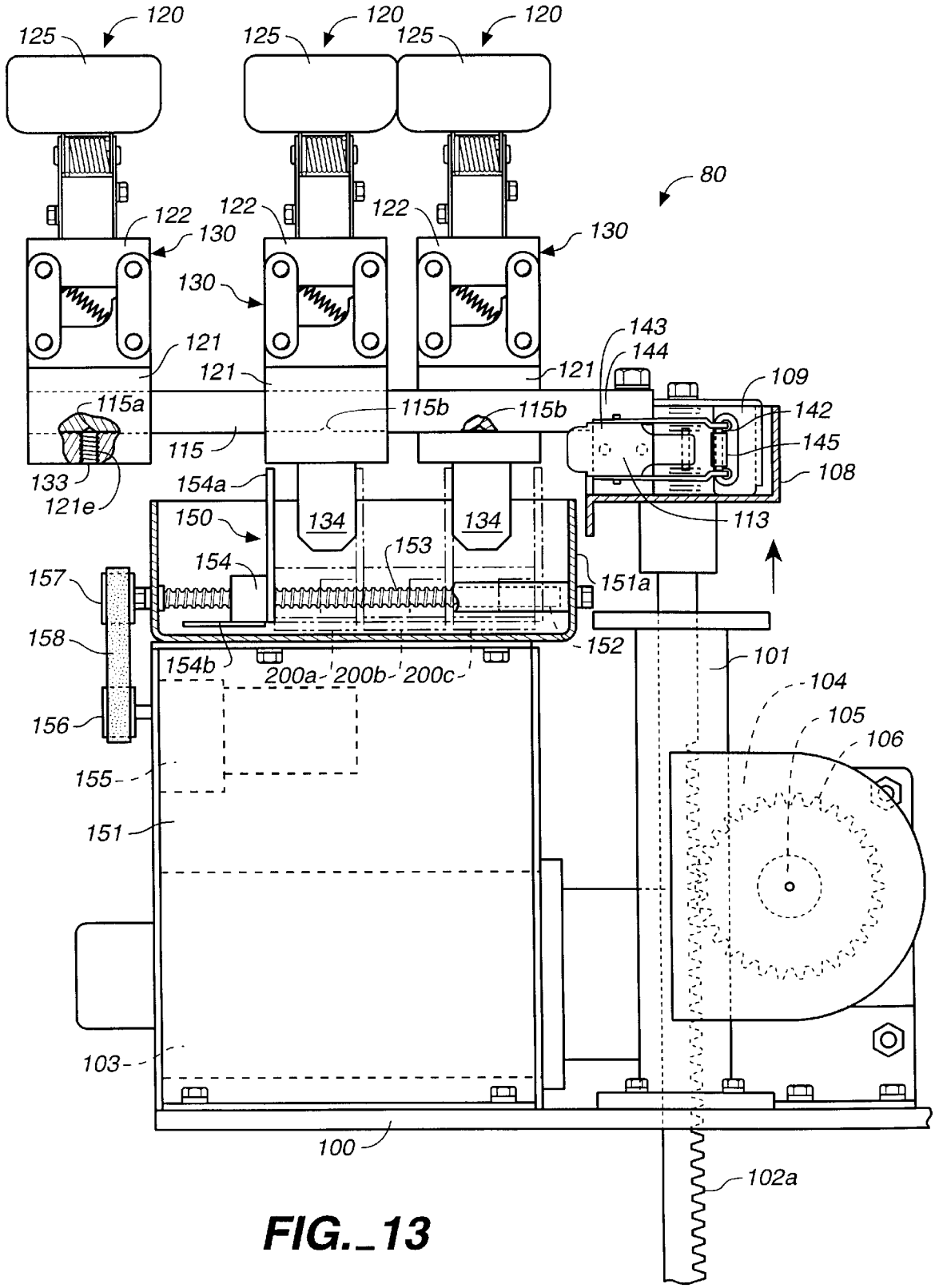
FIG. 13 is a side view of the lift mechanism.
Figure 14:
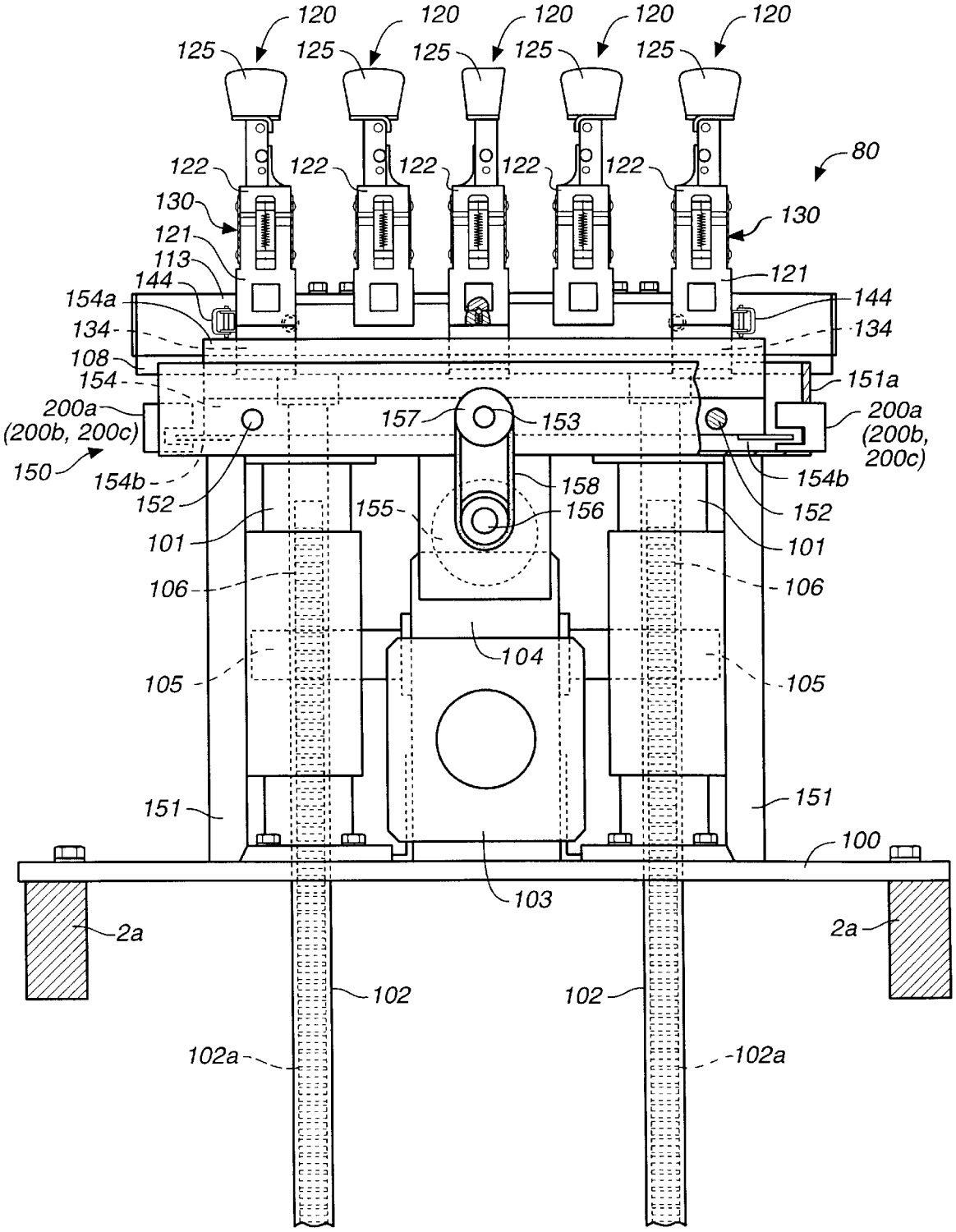
FIG. 14 is a front view of the lift mechanism.

As shown in FIGS. 13 and 14, there are two guide cylinders 101 affixed, with a suitable distance therebetween, to the upper surface at a frontal position of a support frame 100 horizontally attached to main frames 2*a* of the main body 2 of the packaging machine 1. Inside each guide cylinder 101 is a lifting rod 102 (serving as the lifting means) which is capable of moving vertically upward and downward therein and a part of which is formed as a rack gear 102*a*. A servo motor serving as a lift-driving motor 103 is affixed on the same support frame 100 at a backward position such that its rotary motion is communication through a gear box 104 to a pair of power output shafts 105, one to the right and the other to the left. A pinion 106 is attached to each of the power output shafts 105 and engages the rack gear 102*a* on corresponding one of the lifting rods 102.

Figure 17:
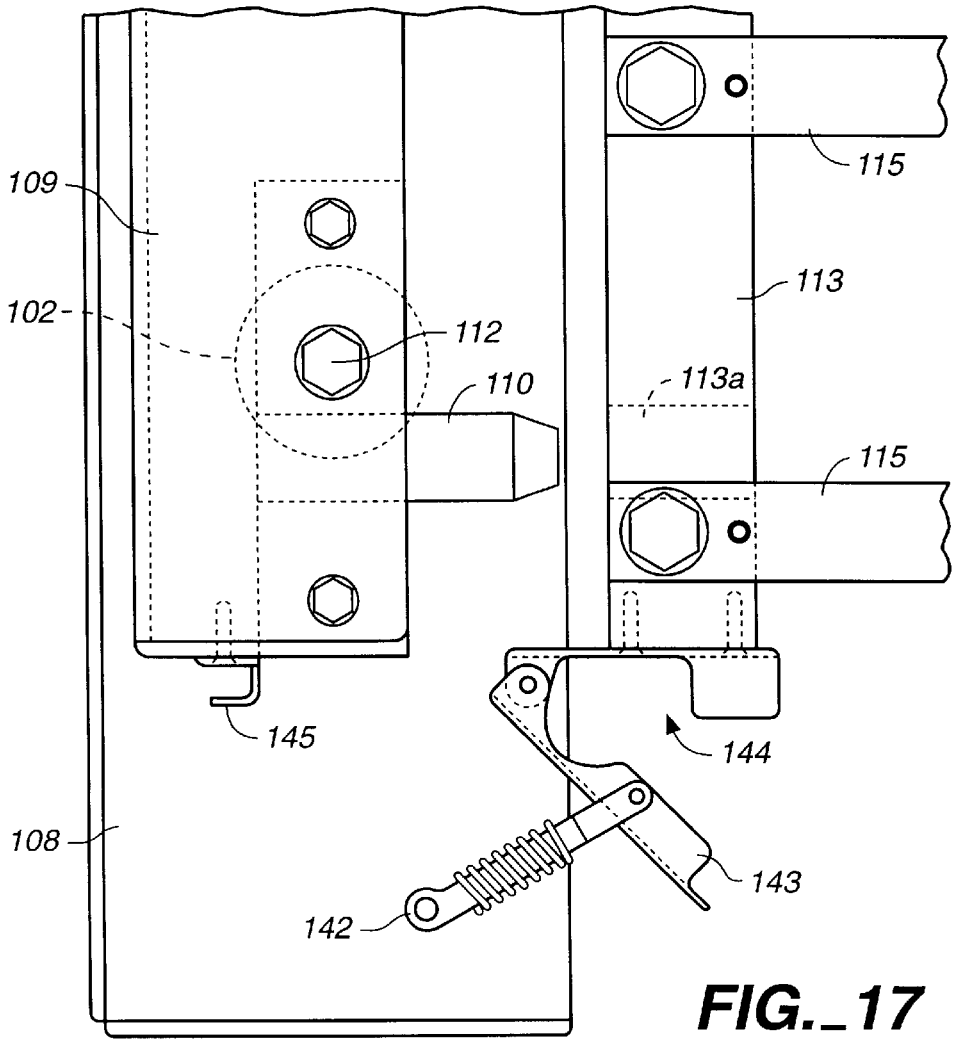
FIG. 17 is a view showing the attachment of the base table to the lift frame.

The lifting rods 102 protrude upward above the top ends of their guide cylinders 101, and a lift frame 108 is supported horizontally by the top ends of the lifting rods 102. As shown in FIGS. 13 and 17, a cross-sectionally L-shaped bracket 109 is attached to the upper surface of the lift frame 108, and a pair of connector blocks 111, each having a backwardly protruding pin 110, is attached at both end positions of this bracket 109. The top ends of the lifting rods 102 not only penetrate the lift frame 108 but also extend to the connector blocks 111 to be affixed thereto by bolts 112. Thus, the lift frame 108, the bracket 109 and the connector blocks 111 are adapted to move upward and downward as a single body with the lifting rods 102 when the lift-driving servo motor 103 is activated. Although not shown, there is provided an encoder for encoding the vertical distance of travel by this combination.

Figure 15:
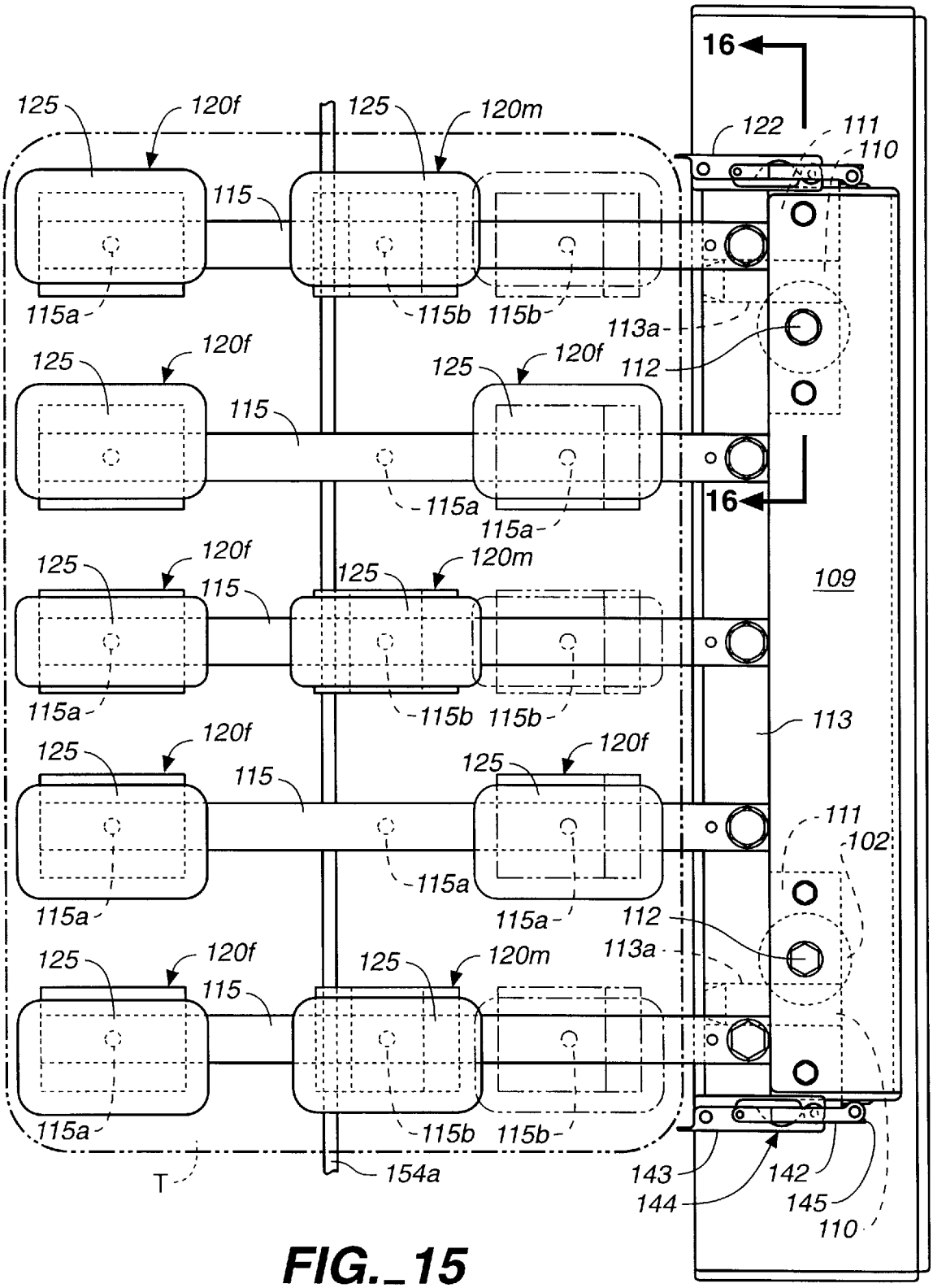
FIG. 15 is a plan view of the lift mechanism with portions thereof removed.

As shown more clearly in FIG. 15, a base table 113 is attached to the bracket 109, penetrated by the protruding pins 110. A plurality of (five in the example shown in FIG. 15) cross-sectionally quadrangular base rods 115 are attached to the base table 113 sequentially, with appropriate intervals therebetween, each base rod 115 supporting two lift posts 120 (one in front of the other). Of these lift posts 120, those on the frontal side and those on the backside on the second base rods 115 from either end are firmly attached and will be hereinafter referred to as fixed posts, indicated by symbols 120*f* in FIG. 15. The remaining three lift posts 120, which are on the backside on the first, third and fifth base rods 115 (counted from either side), are each slidable along the respective base rod 115 to a position shown by dotted lines and hence will be referred to as mobile posts (indicated by symbols 120*m* in FIG. 15).

Next, the lift posts 120 on the two base rods 115 on the right-hand side in FIG. 14 will be used as an example to describe their structure.

Figure 18:
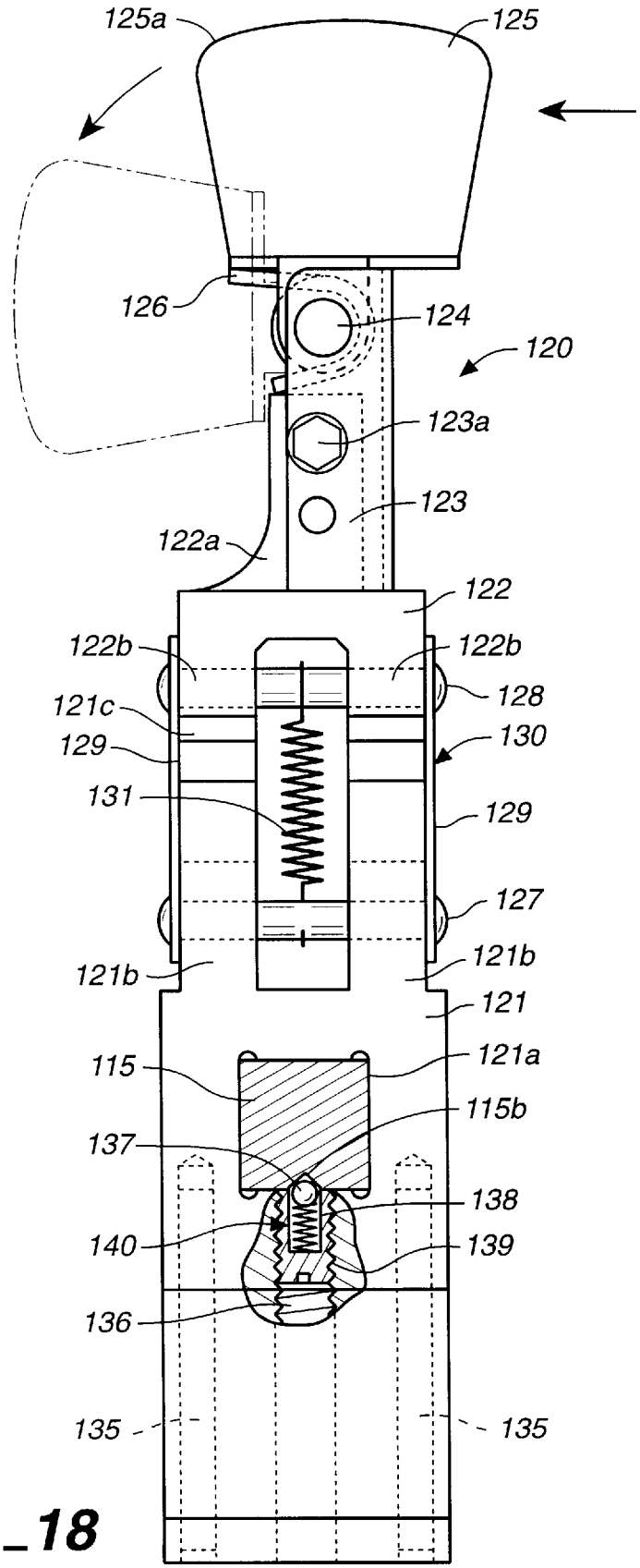
FIG. 18 is a front view of a lift post.
Figure 19:
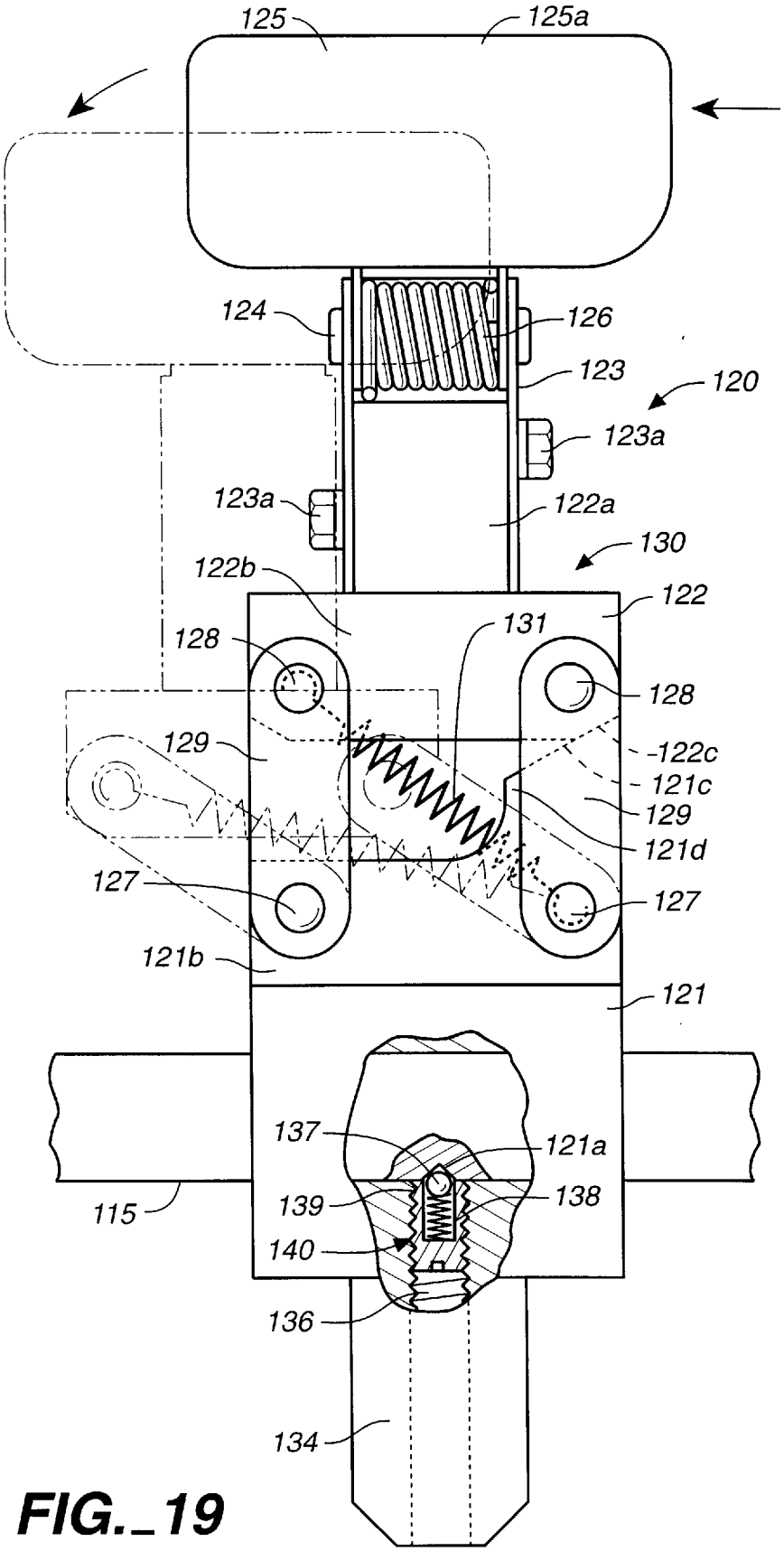
FIG. 19 is a side view of the lift post of FIG. 18.

As shown in FIGS. 18 and 19, each lift post 120 has a base block 121 and a middle block 122. The base block 121 has an opening 121*a* for engagement, cross-sectionally quadrangular in shape, corresponding to the cross-sectional shape of the base rod 115. The middle block 122 is above and connected to the base block 121 and has a columnar upward protrusion 122*a*, to which is attached a cross-sectionally U-shaped connecting member 123 by bolts 123*a*. A lift head 125 with a rectangular top surface 125*a* for supporting articles in a tray thereon is rotatably attached to the top of this connecting member 123 through a supporting shaft 124. A spring 126 is provided around the supporting shaft 124 such that its biasing force tends to normally maintain the top surface 125*a* of the lift head 125 in the upward direction, while allowing the lift head 125 to tilt in the direction of the curved arrow (in FIG. 18) if an external force as indicated by a horizontal arrow (in FIG. 18) is applied thereon.

The base block 121 and the middle block 122 have side walls 121*b* and 122*b*, respectively, connected by pairs of connector pins 127 and 128 which penetrate them. The parts of the connector pins 127 and 128 protruding sideways from the base block 121 and the middle block 122 are connected by pairs of connector pieces 129, as shown in FIG. 19, to form a parallelogram linking mechanism 130. Each side wall 121*b* has a contact part 121*d* which protrudes upward and has an inclined surface 121*c*. The connector pins 127 are where the contact part 121*d* is formed. Between a pair of connector pins 127 and 128 which are in a diagonal relationship, there is provided a spring 131 in the inner space of the blocks 121 and 122.

The lower surface of the middle block 122 is formed with sloped parts 122*c* such that, when the middle block 122 is in the upright position by the biasing force of the spring 131 and hence the aforementioned connector pieces 129 are in upright positions, the inclined surfaces 122*c* and 121*c* of the middle block 122 and the base block 121, respectively, will come into contact with each other. In summary, the biasing force of the spring 131 tends to normally keep the middle block 122 upright, as shown by solid lines in FIG. 19, but if an external horizontal force as indicated by a horizontal arrow in FIG. 19 is applied to the lift head 125 (when in an upright position due to the spring 126), the middle block 122 will be displaced as shown by a curved arrow in FIG. 19 to a displaced position indicated by broken lines in FIG. 19.

As shown in FIGS. 13 and 15, the base rods 115 are provided with a plurality of fastening holes 115*a* and so-called detente holes 115*b* at specified intervals. As shown in FIG. 13, the base block 121 of each fixed post 120*f* is provided with a bolt hole 121*e* therethrough and reaching the aforementioned opening 121*a* for engagement in the base block 121, and a bolt 133 is inserted therethrough with its front end penetrating one of the fastening holes 115*a* on the lower surface of corresponding one of the base rods 115, thereby fastening the fixed post 120*f* to an end part of the base rod 115.

FIGS. 18 and 19 also show a downwardly protruding member 134 attached to the bottom surface of the base block 121 of each mobile post 120*m* by means of bolts 135. A bolt hole 136 is provided through this downwardly protruding member 134 and the base block 121, reaching the opening 121*a* for engagement therein. A detente unit 140, with a casing 139 which has a spirally notched outer surface and containing therein a detente ball 137 and a biasing spring 138 applying a biasing force outwardly to the detente ball 137, is engagingly inserted into this bolt hole 136 such that the detente ball 137 partially protrudes into the opening 121*a* for engagement. The downwardly protruding members 134 are adapted to be pushed in the longitudinal direction of the base rods 115 by an interval adjusting mechanism 150 (shown in FIGS. 13 and 14, and to be described in detail below) such that the mobile posts 120*m* move longitudinally along the base rods 115 and each detente ball 137 will fit into either of two detente holes 115*b* on the bottom surface of each base rod 115. Thus, the mobile post 120*m* comes to be held at either of the two positions along the corresponding base rod 115, one closer to the base table 113 or the other at an intermediate position between the base table 113 and the fixed post 120*f*, as shown in FIG. 15.

Figure 16:
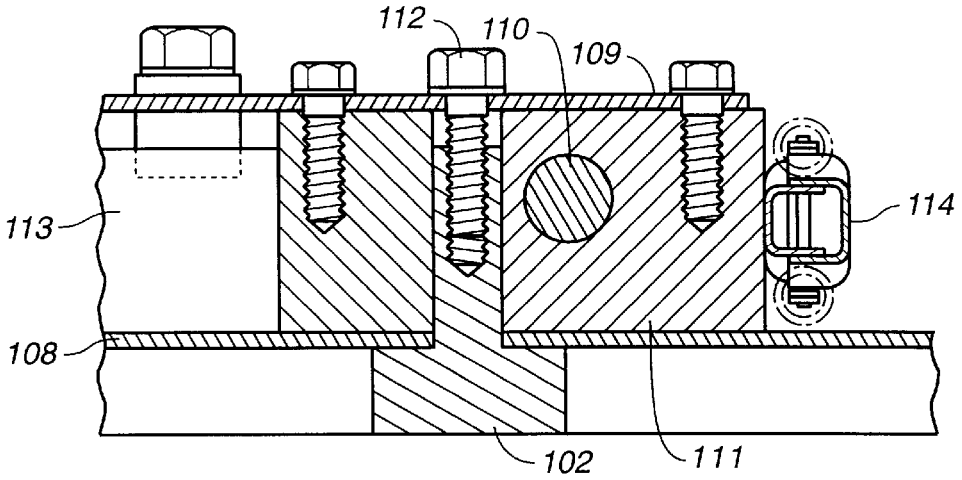
FIG. 16 is a sectional view taken along line 16—16 of FIG. 15.

On each side surface of the base table 113 having the five base rods 115 and the lift posts 120, there is provided a connector lock 144 having a connector ring 142 and a lever 143 for the ring 142, as shown in FIG. 17. On each side surface of the aforementioned bracket 109, there is attached a hook 145 such that the connector ring 142 of the connector lock 144 on the same side can hold the hook 145. The base table 113 and the lift frame 108 can be detachably attached to each other by placing the base table 113 opposite the connector blocks 111 as shown in FIGS. 15 and 16, engaging their pins 110 into two holes 113*a* formed through the base table 113 as shown in FIG. 17, and closing the lock 144 thereafter.

With the lift 80 thus structured, if the lift-driving servo motor 103 is rotated in a positive or negative direction, this rotary motion is communicated through the pinions 106 and converted into a vertical upward or downward linear motion of the lifting rods 102, thereby moving upward or downward the lift frame 108 connected to the lifting rods 102, as well as the base rods 115 and the lift posts 120 supported thereon.

As shown in FIGS. 13 and 14, the interval adjusting mechanism 150, briefly referenced above, comprises a pair of side frames 151 at a backward position on the upper surface of the support frame 100, and a bracket 151*a* with an open top attached to the top of the side frames 151 so as to be right below the base rods 115 of the lift 80. Inside the bracket 151*a*, there is a pair of guide rods 152 disposed one on each side and a screw shaft 153 disposed in the middle, each extending parallel to the base rods 115 and supported at both ends by the front and back walls of the bracket 151*a*. Below the bracket 151*a* and between the side frames 151 is a block-sliding motor 155. A follower pulley 157 is attached to the protruding front end of the screw shaft 153 and is connected in a motion-communicating relationship through a belt 158 with a driver pulley 156 affixed to the drive shaft of the block-sliding motor 155.

The bracket 151*a* further contains therein a slide block 154 which extends in the direction of width of the bracket 151*a*, having the guide rods 152 slidably inserted therethrough and being screwed to the screw shaft 153. Thus, if the block-sliding motor 155 is activated and the screw shaft 153 is caused to rotate through the two pulleys 156, 157 and the belt 158, the slide block 154 slides linearly backward or forward along the guide rods 152 inside the bracket 151*a*.

Figure 20:
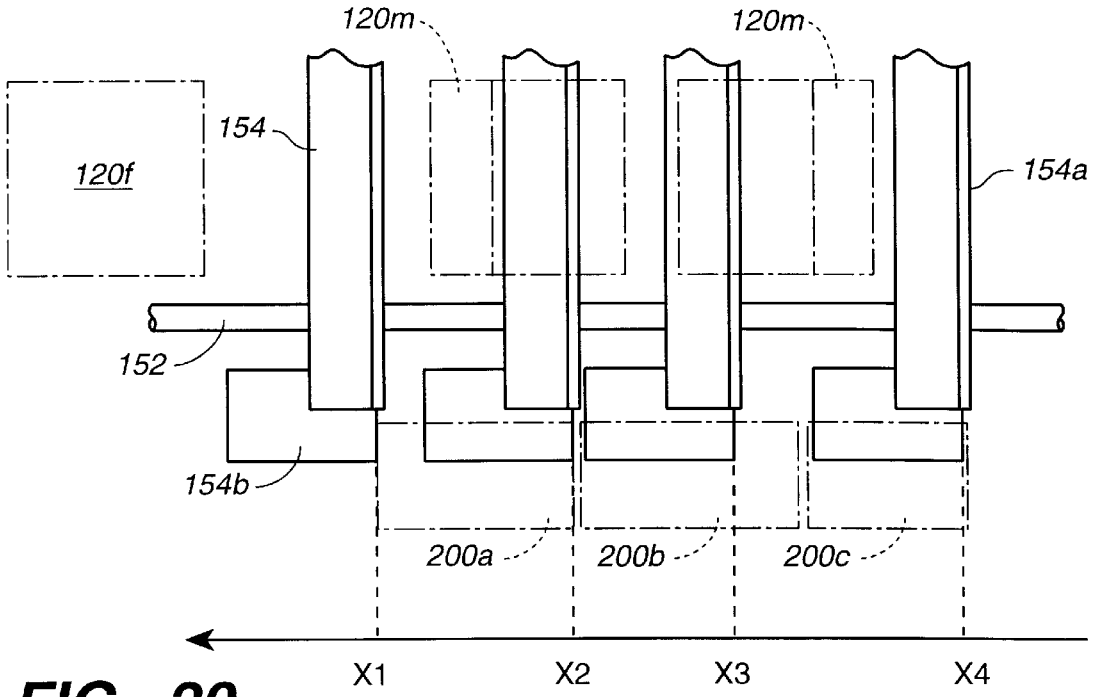
FIGS. 20 and 21 are diagrams for explaining the operation of the interval-adjusting mechanism according this invention.
Figure 21:
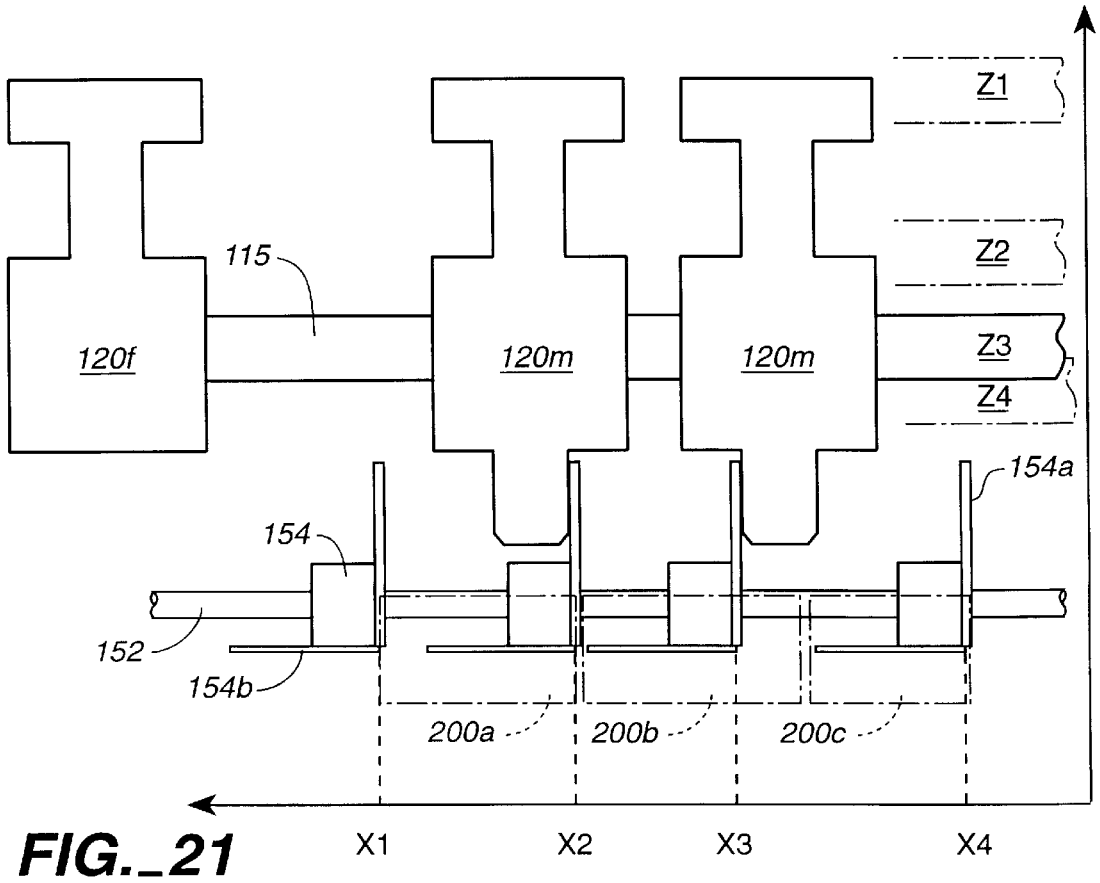
Figure 22:
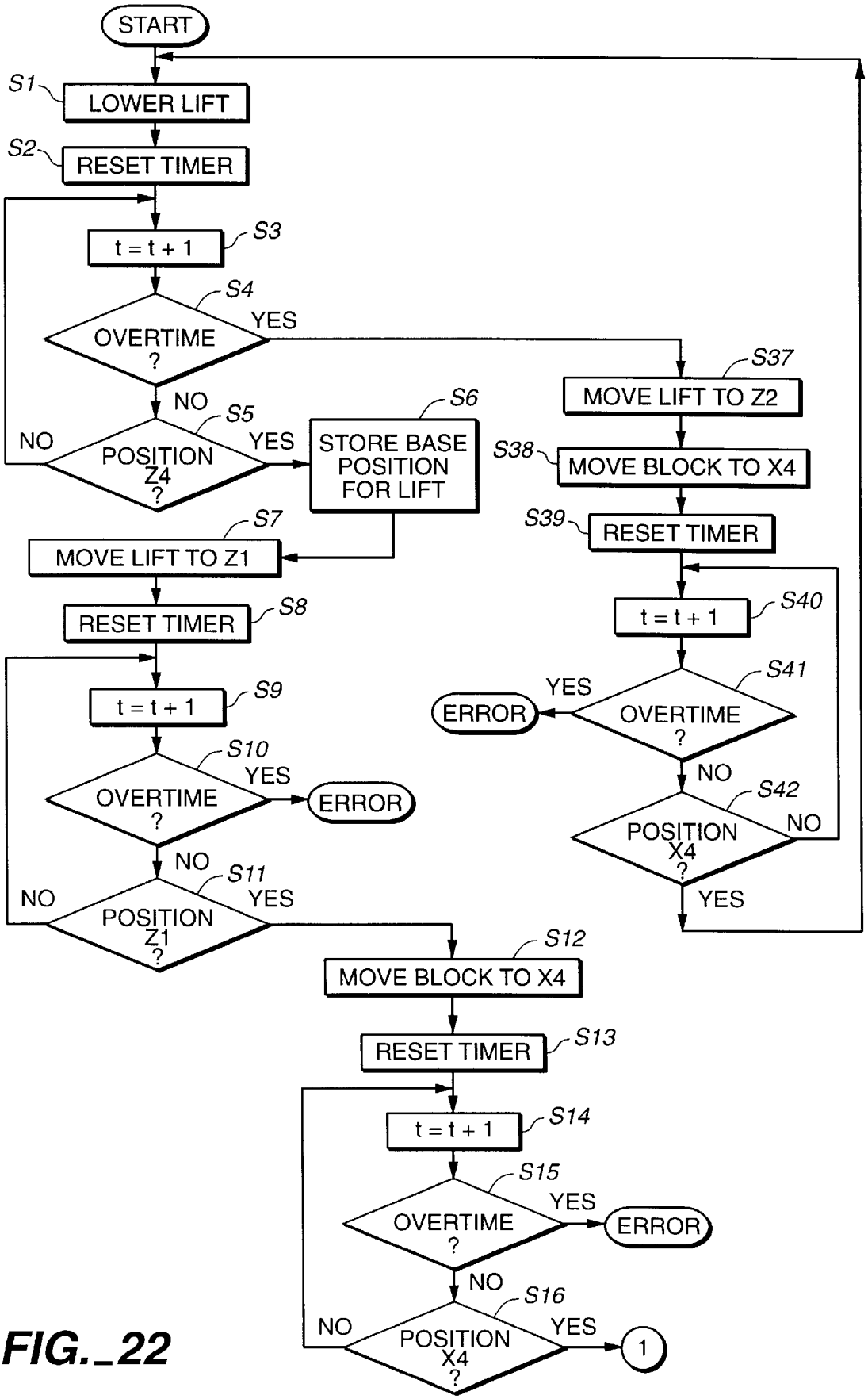
FIGS. 22–25 are flow charts of the control for the interval-adjusting mechanism.
Figure 23:
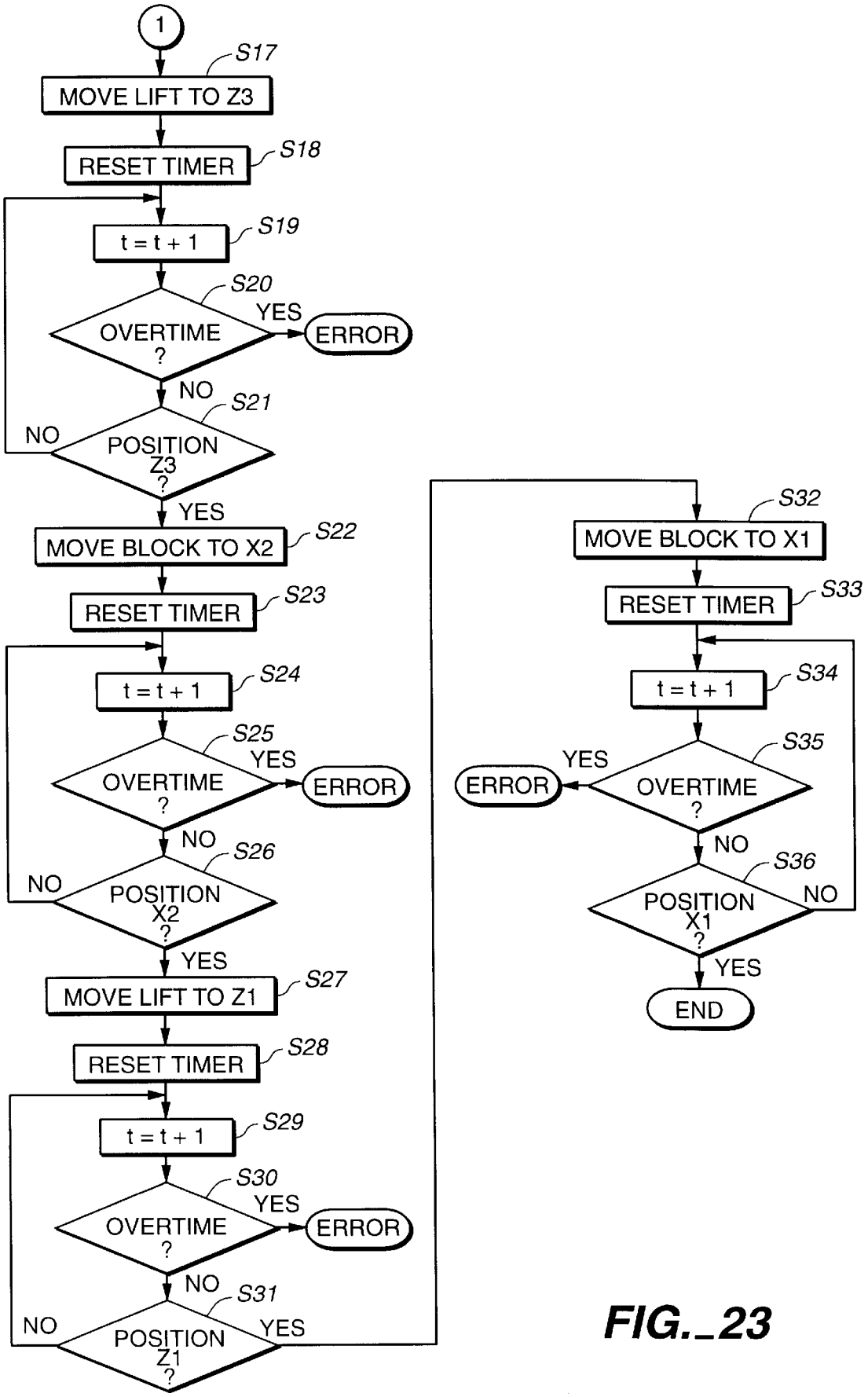
Figure 24:
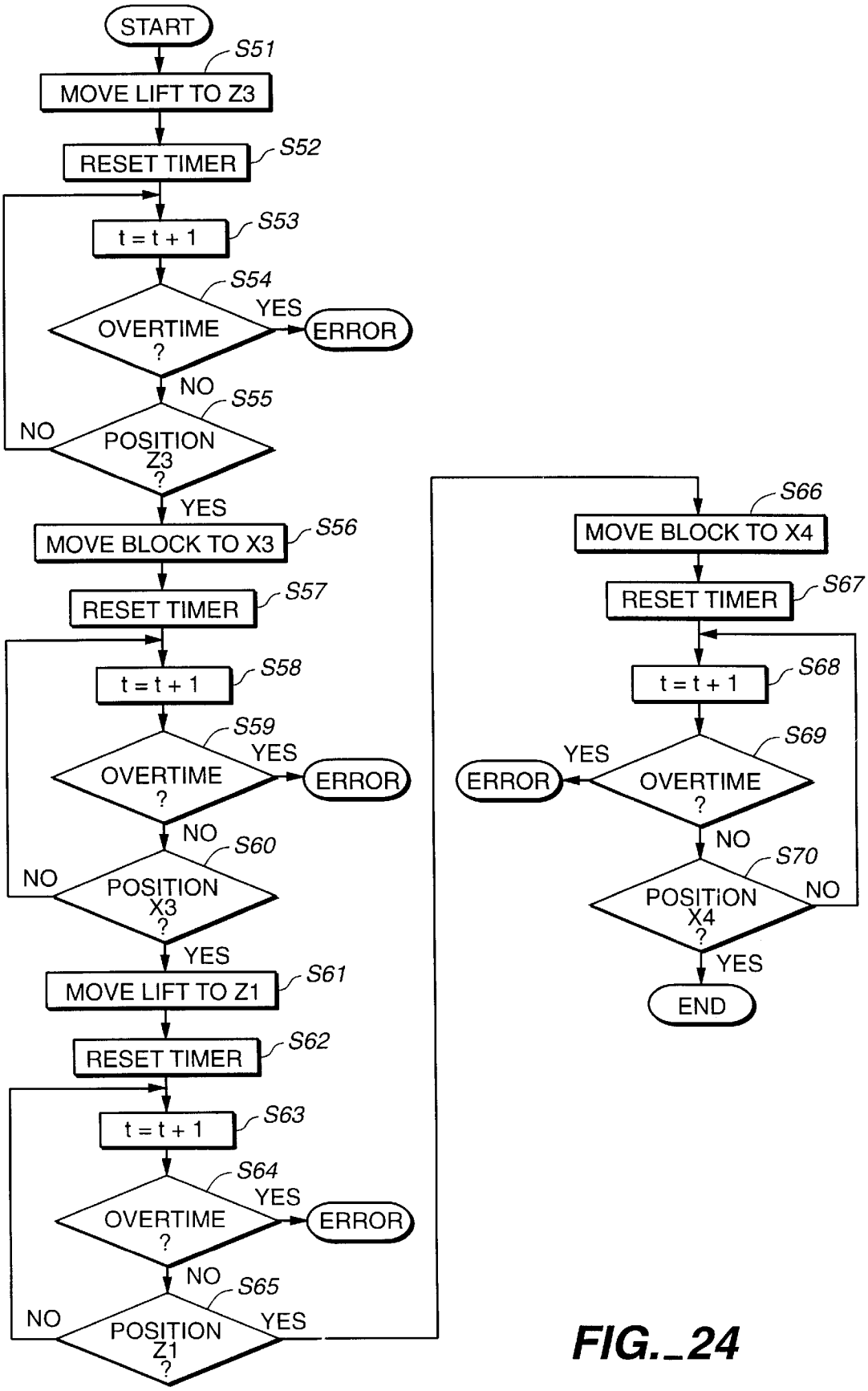
Figure 25:
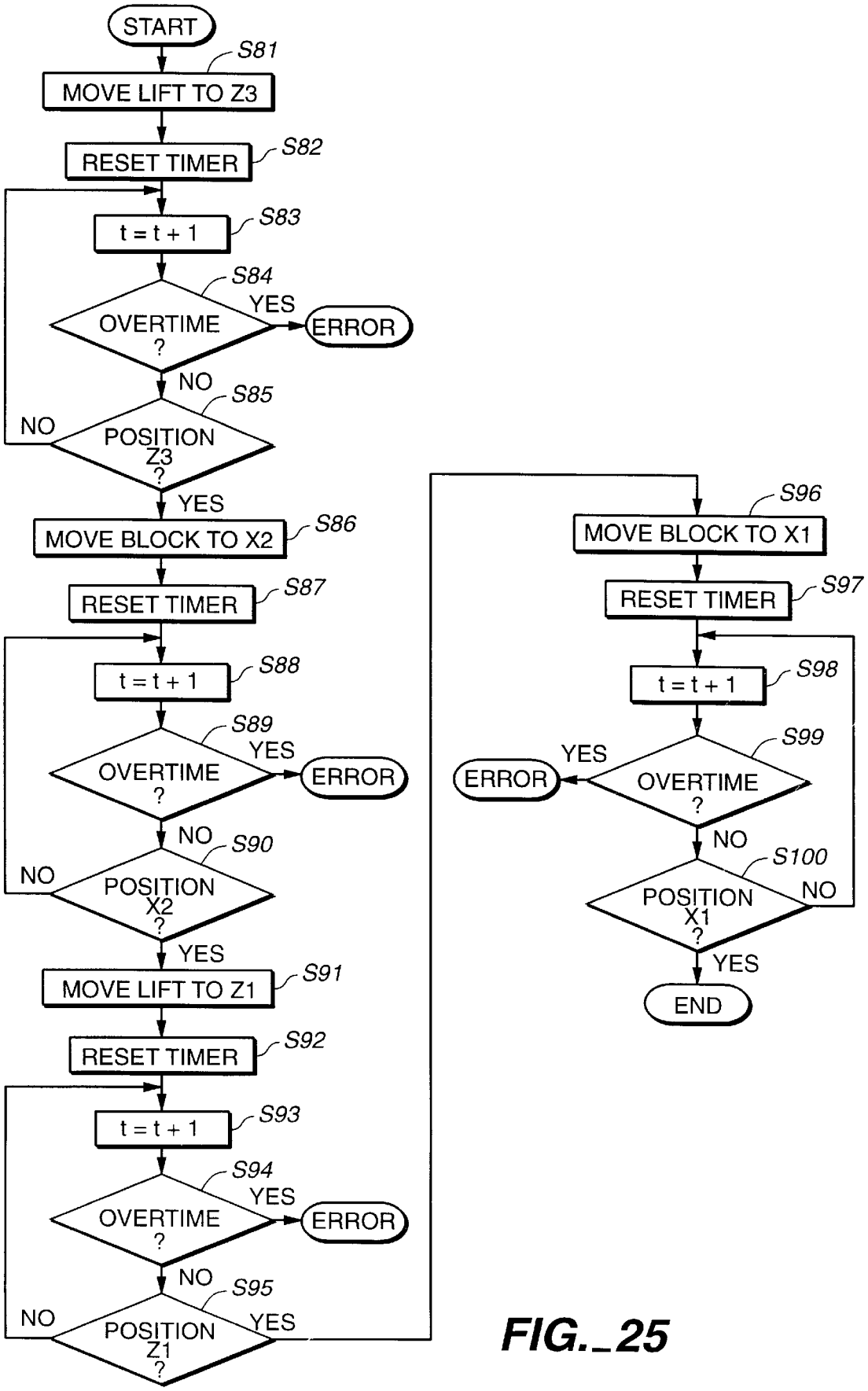

As shown also in FIGS. 20 and 21, a pusher plate 154*a* is attached to the back surface of this slide block 154, protruding upward therefrom and extending over the length (transverse to the direction of the base rods 115). Light-blocking plates 154*b* are attached at both sides onto the bottom surface of the slide block 154, extending forward and sideways, for indicating the position of the slide block 154.

The side walls of the bracket 151*a* are provided with light-passing slits extending in horizontal directions and, as shown in FIGS. 20 and 21, three photo-coupler sensors 200*a*, 200*b*, 200*c* are provided sequentially along the direction of sliding motion of the slide block 154, adapted to emit light through these slits and to output a detection signal when the passage of the light is interrupted. The main control 78 controls the operations of the lift-driving servo motor 103 and the block-sliding motor 155 according to the detection signal (ON for detection and OFF for non-detection) so as to change the positions of the mobile posts 120*m* and to adjust the distances among the lift posts 120 (although FIG. 8 shows simply that the main control 78 controls the lift 80 as a whole).

Explained more in detail with reference to FIG. 21, the lift frame 108, which is normally at its home position far enough above and hence separated from the interval adjusting mechanism 150, is lowered such that its base rods 115 will move from Position Z1 to Position Z3. The slide block 154 is then caused to slide forward or backward such that its pusher plate 154*a* comes into contact with the downwardly protruding members 134 of the mobile posts 120*m* and push these mobile posts 120*m* along the base rods 115. The distance between the fixed and mobile posts 120*f*, 120*m* can thus be varied. If the slide block 154 is moved from its most forward position, or "the forward wait position" (Position X1 in FIGS. 20 and 21), to an appropriately backward position (Position X3), the mobile posts 120*m* which were at their forward positions are moved to their backward positions. If the slide block 154 is moved from its most backward position, or "the backward wait position" (position X4) to an appropriately forward position (Position X2), the mobile posts 120*m* which were at their backward positions are moved to their forward positions.

When the slide block 154 is moved from Position X1 to Position X3, only the sensor 200*b* in the middle detects the light-blocking plates 154*b* such that the signal pattern from the three sensors 200*a*, 200*b*, 200*c* will be OFF-ON-OFF. When the slide block 154 further moves backward to Position X4, only the third sensor 200*c* will detect the light-blocking plate 154*b* and the signal pattern will be OFF-OFF-ON. When the slide block 154 is then moved forward to Position X2, only the first sensor 200*a* makes the detection such that the signal pattern will be ON-OFF-OFF. When the slide block 154 is moved further forward to Position X1, none of the sensors 200*a*, 200*b*, 200*c* has its light blocked and the signal pattern will be OFF-OFF-OFF. Thus, the slide block 154 is adapted to be stopped when the signal pattern changes from one to another of these known patterns.

Next the flow charts in FIGS. 22–25 are referenced for describing the control by the control unit.

The initialization part of the control includes the lowering of the lift 80 (Step S1), the resetting of a timer (Step S2) to start counting time (Step S3) and, after it is ascertained by a lift position sensor (not shown) that the lift 80 has come down to its lowered position (Position Z4 shown in FIG. 21) within a specified time (Steps S4 and S5), the storage in a memory of this position as the zero-height for the lift 80 (Step S6), or to set the zero-point of the encoder.

If the arrival of the lift 80 to Position Z4 cannot be ascertained within the specified time (YES in Step S4), the lift 80 is momentarily moved up to an intermediate position (Position Z2) between Positions Z1 and Z3 (Step S37) and the slide block 154 is moved to the most backward position (Position X4) (Step S38). In other words, if the lift 80 cannot reach the bottom position within the specified time, it is assumed to be the slide block 154 that is in a wrong position and should be moved. The time required for the slide block 154 to reach Position X4 is counted (Steps S39–S42) and, if it fails to reach Position X4 within a specified length of time (YES in Step S41), an error message is displayed on the console 91. Whenever the lift 80 or the slide block 154 is moved from one position to another throughout this program, the time required to do so is monitored and, if it is found that it was not accomplished within a time period specified for that movement, an error message is displayed on the console 91 or an appropriate warning device is activated. In what follows in the explanation of the flow charts of FIGS. 24–25, the possibility of displaying an error message will not be mentioned for each sequence of operations for moving the lift 80 or the slide block 154 from one position to another, although this possibility is shown in the flow charts.

Next, after the lift 80 is moved to Position ZI (Steps S7–S11) and the slide block 154 is pushed to the backward wait position (Position X4) (Steps S12–16), the lift 80 is lowered to Position Z3 (Steps S17–S21) and the slide block 154 is moved to Position X2 (Steps S22–S26), causing the three mobile posts 120*m* to be pushed by the pusher plate 154*a* to their forward positions. The lift 80 is then returned to Position Z1 (Steps S27–S31) and the slide block 154 is moved forward to Position X1 (Steps S32–S36). This will be considered the end of the initialization procedure because the lift posts 120 are now in the dense-distribution pattern for receiving smaller trays and the slide block 154 is at Position X1, which is its forward wait position, ready to change the pattern for receiving larger trays.

Next, when the intervals between the lift posts 120 are to be increased, the lift 80 is first lowered to Position Z3 (Steps S51–S55) and the slide block 154 is moved to Position X3 (Steps S56–S60) to thereby push the mobile posts 120*m* to their backward positions. In order to be prepared for the next operation, the lift 80 is raised again to Position Z1 (Steps S61–S65) and the slide block 154 is moved to Position X4 (Steps S66–S70), which is its backward wait position.

In order to change the pattern back to that for receiving smaller trays, the lift 80 is lowered to Position Z3 (Steps S81–S85) and the slide block 154 is moved to Position X2 (Steps S86–S90), thereby pushing the mobile posts 120*m* to their forward positions closer to corresponding ones of the fixed posts 120*f*. In order to be prepared for the next operation represented in the flow chart of FIG. 24, the lift is raised again to Position Z1 (Steps S91–S95) and the slide block 154 is moved to Position X1 (Steps S96–S100), which is its forward wait position.

Although the present invention has been described above with reference to only one embodiment with only a few variations, this is not intended to limit the scope of the invention. Many modifications and variations are possible within the scope of the invention. For example, although an embodiment of the invention was described above whereby the lift 80 was to be lowered to Position Z3 such that the mobile posts 120*m* could be pushed by the pusher plate 154*a* affixed to the slide block 154, this is not intended to limit the scope of the invention. It is also feasible to raise the entire interval adjusting mechanism 150, for example, by means of rack gears and pinions, so as to make it come closer to the mobile posts 120*m*.

In summary, the present invention teaches firstly how to supply different films to the packaging station of a packaging machine without adversely affecting the workability of the machine. The invention teaches secondly how to reduce the number of sensors for a packaging machine adapted to switch the direction of film transportation by its film transporting mechanism, by providing sensors at both ends of transportation belts and making them function both as an overrun detection sensor for detecting the presence of an overrun situation and a film detection sensor for detecting an interruption in the film supply, depending on how the direction of film transportation has been switched. If a pair of sensors is provided at each end of the transportation belts, one on each side of the belts, even an abnormal situation occurring only on one side can be detected.

The present invention teaches thirdly how to efficiently move a plurality of lift posts by using a single slidable block to change the post density quickly such that both larger and smaller trays can be dependably lifted. Since the slide block is retracted to a forward or backward wait position after each pushing operation, it can align the lift posts dependably even when they are at random positions, say, after a periodic cleaning operation of the apparatus for maintenance. It is also to be noted that the same number of sensors are normally required as the number of positions where the slide block is stopped, but that, according to this invention, the number of sensors required is less than that number by one.

What is claimed is:

1. A film supplying apparatus for a packaging machine comprising:

film transporting belts which extend longitudinally between a first end position and a second end position and are capable of clamping both side edges of a film and moving said clamped film selectively in either direction longitudinally;

storage spaces capable of storing therein two film rolls with films having various widths;

a pair of film guiding mechanisms each capable of pulling a film out of an associated one of said film rolls and guiding said pulled film to an associated one of said first and second end positions of said film transporting belts; and a controller adapted, when said film transporting belts are in motion, to selectively activate one of said film guiding mechanisms that is on the upstream side of said motion, said controller further serving to control said film transporting belts and said film guiding mechanism according to the various width of said film and such that said film transporting belts automatically clamp said film.

2. The film supplying apparatus of claim 1 wherein each of said film guiding mechanisms includes:

film guiding belts serving to transport said pulled film to said associated one of said first and second end positions of said film transporting belts;

a clamping mechanism capable of clamping edges of said pulled film; and a retracting mechanism for lowering said film guiding belts to a lowered position so as to contact said pulled film when said film guiding mechanism is in operation and lifting said film guiding belts to a retracted position above said film transporting belts while said film remains clamped by said clamping mechanism when said film guiding mechanism is not in operation.

3. The film supplying apparatus of claim 2 wherein said clamping mechanism includes a pair of clamping members supported by a rotatable rod and backing members each associated with one of said clamping members such that said clamping members can be rotated around said rod from a non-clamping position to a clamping position to clamp said film between end surfaces of said clamping members and said backing members, one of said clamping members being slidable along said rod such that the separation between said pair of clamping members can be changed.

4. The film supplying apparatus of claim 1 further comprising switching means for switching the direction of transporting said film by said film transporting belts.

5. The film supplying apparatus of claim 1 further comprising sensors capable of detecting presence and absence of a film, a first group of said sensors being disposed at said first end position, a second group of said sensors being disposed at said second end position, said controller being further adapted to switch the roles of said first group and said second group of sensors, depending on the direction of film transportation by said film transporting belts, said first group of sensors serving to output a warning signal when said film is detected thereby and said second group of sensors serving to output a warning signal when the absence of film is detected thereby if the direction of film transportation by said film transporting belts is from said second end position to said first end position, said first group of sensors serving to output a warning signal when the absence of film is detected thereby and said second group of sensors serving to output a warning signal when said film is detected thereby if the direction of film transportation by said film transporting belts is from said first end position to said second end position.

6. The film supplying apparatus of claim 5 wherein said first group and said second group each include two of said sensors each on opposite transverse side of said film transporting belts.

7. The film supplying apparatus of claim 5 wherein those of said sensors, of which the role has been switched by said controller to the detection of said film, are capable of detecting an overrun condition in said film supplying apparatus, and those of said sensors, of which the role has been switched by said controller to the detection of the absence of film, are capable of detecting an interruption in the supply of film from either of said film rolls.

8. The film supplying apparatus of claim 5 wherein said controller keeps said film transporting belts in motion, when said warning signal is outputted, until a front end of said film reaches a specified starting position, and stops said film transporting belts when said film reaches said starting position.

9. A film supplying apparatus for a packaging machine which includes means for supporting film rolls having thereon films with various widths, film transporting belts extending between a first end position and a second end position and capable of clamping both side edges of an elongated film pulled out longitudinally from selected one of said film rolls and transporting said clamped film longitudinally in one or opposite direction to a packaging station, and switching means for switching the direction of film transportation by said film transporting belts; said film supplying apparatus comprising:

sensors capable of detecting presence and absence of a film, a first group of said sensors being disposed at said first end position, a second group of said sensors being disposed at said second end position; and a controller for switching the roles of said first group and said second group of sensors, depending on the direction of film transportation by said film transporting belts, said first group of sensors serving to output a warning signal when said film is detected thereby and said second group of sensors serving to output a warning signal when the absence of film is detected thereby if the direction of film transportation by said film transporting belts is from said second end position to said first end position, said first group of sensors serving to output a warning signal when the absence of film is detected thereby and said second group of sensors serving to output a warning signal when said film is detected thereby if the direction of film transportation by said film transporting belts is from said first end position to said second end position, said controller further serving to control said film transporting belts according to the various width of said film and such that said film transporting belts automatically clamp said film.

10. The film supplying apparatus of claim 9 wherein said first group and said second group each include two of said sensors each on opposite transverse side of said film transporting belt.

11. The film supplying apparatus of claim 9 wherein those of said sensors, of which the role has been switched by said controller to the detection of said film, are capable of detecting an overrun condition in said film supplying apparatus, and those of said sensors, of which the role has been switched by said controller to the detection of the absence of film, are capable of detecting an interruption in the supply of film from either of said film rolls.

12. The film supplying apparatus of claim 9 wherein said controller keeps said film transporting belts in motion, when said warning signal is outputted, until a front end of said film reaches a specified starting position, and stops said film transporting belts when said film reaches said starting position.

13. A packaging machine comprising:

a weighing apparatus for weighing articles on a tray;

a packaging station;

means for storing film rolls having thereon films with various widths;

film transporting belts extending longitudinally between a first end position and a second end position and being capable of clamping both side edges of an elongated film pulled out longitudinally from a selected one of said film rolls and transporting said clamped film longitudinally in one or opposite direction to said packaging station;

switching means for switching the direction of film transportation by said film transporting belts;

a lift for lifting said articles on said tray, which have been weighed by said weighing apparatus, to said packaging station;

a folding apparatus for wrapping said articles and said tray together in a piece of said film at said packaging station;

a pair of film guiding mechanisms each capable of pulling a film out of an associated one of said film rolls and guiding said pulled film to an associated one of said first and second end positions of said film transporting belts; and a controller adapted, when said film transporting belts are in motion, to selectively activate one of said film guiding mechanisms that is on the upstream side of said motion, said controller further serving to control said film transporting belts according to the various width of said film and such that said film transporting belts automatically clamp said film.

14. The packaging machine of claim 13 wherein each of said film guiding mechanisms includes:

film guiding belts serving to transport said pulled film to said associated one of said first and second end positions of said film transporting belts;

a clamping mechanism capable of clamping edges of said pulled film; and a retracting mechanism for lowering said film guiding belts to a lowered position so as to contact said pulled film when said film guiding mechanism is in operation and lifting said film guiding belts to a retracted position above said film transporting belts while said film remains clamped by said clamping mechanism when said film guiding mechanism is not in operation.

15. The packaging machine of claim 14 wherein said clamping mechanism includes a pair of clamping members supported by a rotatable rod and backing members each associated with one of said clamping members such that said clamping members can be rotated around said rod from a non-clamping position to a clamping position to clamp said film between end surfaces of said clamping members and said backing members, one of said clamping members being slidable along said rod such that the separation between said pair of clamping members can be changed.

16. The packaging machine of claim 13 further comprising switching means for switching the direction of transporting said film by said film transporting belts.

17. A packaging machine comprising:

a weighing apparatus for weighing articles on a tray;

a packaging station;

means for storing film rolls;

film transporting belts extending longitudinally between a first end position and a second end position and being capable of clamping both side edges of an elongated film pulled out longitudinally from a selected one of said film rolls and transporting said clamped film longitudinally in one or opposite direction to said packaging station;

switching means for switching the direction of film transportation by said film transporting belts;

a lift for lifting said articles on said tray, which have been weighed by said weighing apparatus, to said packaging station;

a folding apparatus for wrapping said articles and said tray together in a piece of said film at said packaging station;

a pair of film guiding mechanisms each capable of pulling a film out of an associated one of said film rolls and guiding said pulled film to an associated one of said first and second end positions of said film transporting belts; and a controller adapted, when said film transporting belts are in motion, to selectively activate one of said film guiding mechanisms that is on the upstream side of said motion;

said lift comprising:

a frame;

frame-lifting means for moving said frame selectively upward or downward;

a plurality of posts standing on said frame for supporting trays thereon, said posts including fixed posts, which are affixed to said frame, and mobile posts, which can move in a specified direction within a specified range each towards or away from associated one of said fixed posts;

guide members affixed to said frame and extending in said specified direction; and a slidable member extending perpendicularly to said specified direction and being mounted on and capable of sliding along said guide members in said specified direction beyond said specified range;

said controller being further adapted to stop said slidable member at a plurality of stop positions within said specified range and wait positions outside said specified range and to cause said slidable member and said mobile posts to move towards or away from each other at any of said stop positions.

18. The packaging machine of claim 17 further comprising a plurality of position sensors each for outputting a detection signal for detecting said slidable member and a non-detection signal for not detecting said slidable member, said position sensors being disposed in said specified direction such that a combined pattern of said detection signals changes differently at each of said stop positions, said control means causing said slidable member to stop when said pattern of detection signals changes.

19. A packaging machine comprising:

a weighing apparatus for weighing articles on a tray;

a packaging station;

means for storing film rolls;

film transporting belts extending longitudinally between a first end position and a second end position and being capable of clamping both side edges of an elongated film pulled out longitudinally from a selected one of said film rolls and transporting said clamped film longitudinally in one or opposite direction to said packaging station;

switching means for switching the direction of film transportation by said film transporting belts;

a lift for lifting said articles on said tray, which have been weighed by said weighing apparatus, to said packaging station;

a folding apparatus for wrapping said articles and said tray together in a piece of said film at said packaging station;

a pair of film guiding mechanisms each capable of pulling a film out of an associated one of said film rolls and guiding said pulled film to an associated one of said first and second end positions of said film transporting belts;

a controller adapted, when said film transporting belts are in motion, to selectively activate one of said film guiding mechanisms that is on the upstream side of said motion; and sensors capable of detecting presence and absence of a film, a first group of said sensors being disposed at said first end position, a second group of said sensors being disposed at said second end position;

said controller being further adapted to switch the roles of said first group and said second group of sensors, depending on the direction of film transportation by said film transporting belts, said first group of sensors serving to output a warning signal when said film is detected thereby and said second group of sensors serving to output a warning signal when the absence of film is detected thereby if the direction of film transportation by said film transporting belts is from said second end position to said first end position, said first group of sensors serving to output a warning signal when the absence of film is detected thereby and said second group of sensors serving to output a warning signal when said film is detected thereby if the direction of film transportation by said film transporting belts is from said first end position to said second end position;

said lift comprising:

a frame;

frame-lifting means for moving said frame selectively upward or downward;

a plurality of posts standing on said frame for supporting trays thereon, said posts including fixed posts, which are affixed to said frame, and mobile posts, which can move in a specified direction within a specified range each towards or away from associated one of said fixed posts;

guide members affixed to said frame and extending in said specified direction; and a slidable member extending perpendicularly to said specified direction and being mounted on and capable of sliding along said guide members in said specified direction beyond said specified range;

said controller being still further adapted to stop said slidable member at a plurality of stop positions within said specified range and wait positions outside said specified range and to cause said slidable member and said mobile posts to move towards or away from each other at any of said stop positions.

20. The packaging machine of claim 19 wherein said lift further comprises a plurality of position sensors each for outputting a detection signal for detecting said slidable member and a non-detection signal for not detecting said slidable member, said position sensors being disposed in said specified direction such that a combined pattern of said detection signals changes differently at each of said stop positions, said control means causing said slidable member to stop when said pattern of detection signals changes.

* * * * *